US008556676B2

(12) United States Patent
Bertrand et al.

(10) Patent No.: US 8,556,676 B2
(45) **Date of Patent: *Oct. 15, 2013**

(54) MAGNETIC TOP SYSTEM AND METHOD

(75) Inventors: Vic Bertrand, Beaconfield (CA); Stephen Donahue, Montreal (CA); Patrick Latour, Terrebonne (CA)

(73) Assignee: MEGA Brands International, Zug (CH)

( * ) Notice: Subject to any disclaimer, the term of this patent is extended or adjusted under 35 U.S.C. 154(b) by 0 days.

This patent is subject to a terminal disclaimer.

(21) Appl. No.: 13/492,278

(22) Filed: Jun. 8, 2012

(65) Prior Publication Data

US 2012/0252309 A1 Oct. 4, 2012

Related U.S. Application Data

(62) Division of application No. 12/636,503, filed on Dec. 11, 2009, now Pat. No. 8,210,895.

(60) Provisional application No. 61/140,016, filed on Dec. 22, 2008.

(51) Int. Cl.
*A63H 1/00* (2006.01)

(52) U.S. Cl.
USPC ..... 446/259

(58) Field of Classification Search
USPC ..... 446/259
See application file for complete search history.

(56) References Cited

U.S. PATENT DOCUMENTS

| | | | |
|---|---|---|---|
| 32,272 | A | 5/1861 | Benton |
| 541,802 | A | 6/1895 | Barus |
| 547,764 | A | 10/1895 | Boyum |
| 655,621 | A | 8/1900 | Gustine |
| 755,446 | A | 3/1904 | Butcher |
| 791,080 | A | 5/1905 | Davenport |
| 896,628 | A | 8/1908 | Davenport |
| 1,319,123 | A | 10/1919 | Simon |
| D54,457 | S | 2/1920 | Sandstrom |
| 1,462,091 | A | 7/1923 | Lindstrom |
| 1,503,006 | A | 7/1924 | Rause |
| 1,537,312 | A | 5/1925 | Korona |
| 1,552,530 | A | 9/1925 | Adams |
| 1,570,206 | A | 1/1926 | Connell |

(Continued)

FOREIGN PATENT DOCUMENTS

| | | |
|---|---|---|
| AU | 764822 | 8/2002 |
| BE | 1003925 | 7/1992 |

(Continued)

OTHER PUBLICATIONS

Turbo Tower Totem Tops, Britz'n. Pieces Webpage (http://www.britznpieces.com.au/tops.html) (retrieved Jan. 12, 2009).

(Continued)

*Primary Examiner* — Michael Dennis
(74) *Attorney, Agent, or Firm* — Plumsea Law Group, LLC

(57) ABSTRACT

A magnetic top system for energizing, launching, and controlling movement of a spinning top. In one embodiment, a magnetic top launcher may magnetically couple to a top and induce a spinning motion in the top. A top controlling device may magnetically control a traversing movement of the top on a play surface without directly contacting the top.

20 Claims, 36 Drawing Sheets

(56) References Cited

U.S. PATENT DOCUMENTS

| | | | | |
|---|---|---|---|---|
| 1,680,423 | A | 8/1928 | Lindstrom | |
| 1,783,627 | A | 12/1930 | Raimondi | |
| 1,907,419 | A | 5/1933 | Wetzell | |
| 2,394,093 | A | 5/1946 | Nalle, Jr. | |
| 2,460,221 | A | 1/1949 | Gordon | |
| D156,773 | S | 1/1950 | Schaper | |
| 2,516,727 | A | 7/1950 | Schultheiss | |
| 2,564,053 | A | 8/1951 | Donovan | |
| 2,611,995 | A | 9/1952 | Krapp | |
| 2,618,891 | A | 11/1952 | Pepin | |
| 2,633,664 | A | 4/1953 | Neilson | |
| 2,774,185 | A | 12/1956 | Kosch | |
| 2,842,896 | A | 7/1958 | Sire | |
| 2,879,066 | A | 3/1959 | Sutherland | |
| 2,906,057 | A | 9/1959 | Sullivan | |
| 2,940,216 | A | 6/1960 | Koch | |
| 3,083,498 | A | 4/1963 | Kelley | |
| 3,188,768 | A | 6/1965 | Boswell | |
| 3,224,142 | A | 12/1965 | Pawelka et al. | |
| 3,254,446 | A | 6/1966 | Endris | |
| 3,316,672 | A | 5/1967 | Dixon | |
| 3,318,600 | A | 5/1967 | Glass et al. | |
| 3,323,491 | A | 6/1967 | Granick | |
| 3,443,332 | A | 5/1969 | Christy | |
| 3,473,256 | A | 10/1969 | Tyler | |
| 3,510,949 | A | 5/1970 | Christy | |
| 3,621,605 | A | 11/1971 | Witiak | |
| 3,623,262 | A | 11/1971 | Noda | |
| 3,861,077 | A | 1/1975 | Lindquist | |
| 3,876,205 | A | 4/1975 | Drohomirecky | |
| 3,906,660 | A | 9/1975 | Voth | |
| 3,936,974 | A | 2/1976 | House | |
| 4,200,283 | A * | 4/1980 | Andrews et al. | 273/108 |
| 4,200,289 | A | 4/1980 | Bosley | |
| 4,211,030 | A | 7/1980 | Morrison et al. | |
| 4,295,290 | A | 10/1981 | Boswell | |
| 4,382,245 | A | 5/1983 | Harrigan | |
| 4,538,999 | A | 9/1985 | Orlowski | |
| 4,575,346 | A | 3/1986 | Ogawa | |
| 4,590,381 | A | 5/1986 | Mendelson | |
| 4,745,286 | A | 5/1988 | Jones | |
| 4,828,258 | A | 5/1989 | Gebert | |
| 4,932,918 | A | 6/1990 | Onoda | |
| 4,946,413 | A | 8/1990 | Lehmann et al. | |
| 4,982,961 | A | 1/1991 | Ichimura | |
| 5,007,877 | A | 4/1991 | Watson | |
| 5,020,798 | A | 6/1991 | Yang | |
| 5,024,625 | A | 6/1991 | MacCarthy | |
| 5,026,057 | A | 6/1991 | Watford | |
| 5,122,089 | A | 6/1992 | Haran | |
| 5,135,425 | A * | 8/1992 | Andrews et al. | 446/133 |
| 5,203,702 | A | 4/1993 | Wilson | |
| 5,324,226 | A | 6/1994 | McKay et al. | |
| 5,404,062 | A | 4/1995 | Hones et al. | |
| 5,480,338 | A | 1/1996 | Barthold | |
| 5,498,192 | A | 3/1996 | McKay et al. | |
| 5,525,086 | A | 6/1996 | Gentile et al. | |
| 5,593,338 | A * | 1/1997 | Itoh et al. | 446/259 |
| 5,683,284 | A | 11/1997 | Christen | |
| 5,705,759 | A | 1/1998 | DeVivo | |
| 5,791,966 | A | 8/1998 | Capps et al. | |
| 5,827,107 | A | 10/1998 | Bears et al. | |
| 5,996,998 | A | 12/1999 | Przybilla | |
| 6,150,913 | A | 11/2000 | Simmons | |
| 6,325,690 | B1 | 12/2001 | Nelson | |
| 6,364,734 | B1 | 4/2002 | Ng | |
| 6,485,017 | B1 | 11/2002 | Ng | |
| 6,530,817 | B1 | 3/2003 | Winslow et al. | |
| 6,595,826 | B2 | 7/2003 | Koizumi | |
| 6,604,978 | B1 | 8/2003 | Abel | |
| 6,608,540 | B1 | 8/2003 | Hones et al. | |
| 6,626,729 | B2 | 9/2003 | Osawa | |
| 6,666,742 | B2 | 12/2003 | Koizumi | |
| 6,685,531 | B1 | 2/2004 | Tiefel et al. | |
| 6,739,939 | B2 | 5/2004 | Matsukawa | |
| 6,746,300 | B1 * | 6/2004 | Matsukawa | 446/256 |
| 6,769,953 | B1 | 8/2004 | Sutton et al. | |
| 6,773,328 | B2 | 8/2004 | Tiefel et al. | |
| 6,905,389 | B2 | 6/2005 | Matsukawa | |
| 6,913,506 | B2 | 7/2005 | Tiefel et al. | |
| 7,018,263 | B2 | 3/2006 | Tiefel et al. | |
| 7,063,589 | B2 | 6/2006 | Matsukawa et al. | |
| 7,109,661 | B2 | 9/2006 | Watanabe et al. | |
| 7,249,431 | B1 | 7/2007 | Rose et al. | |
| 7,427,225 | B2 | 9/2008 | Matsukawa et al. | |
| 7,435,152 | B2 | 10/2008 | Kimbrough | |
| 2002/0102907 | A1 | 8/2002 | Osawa | |
| 2003/0199222 | A1 | 10/2003 | Matsukawa et al. | |
| 2004/0076460 | A1 | 4/2004 | Yu et al. | |
| 2007/0128972 | A1 | 6/2007 | Schmidt et al. | |
| 2008/0185441 | A1 | 8/2008 | Henry et al. | |
| 2009/0197503 | A1 | 8/2009 | Grosu | |
| 2010/0159798 | A1 | 6/2010 | Bertrand et al. | |

FOREIGN PATENT DOCUMENTS

| | | |
|---|---|---|
| CN | 2513638 | 10/2002 |
| CN | 200977396 | 11/2007 |
| CN | 201643678 | 11/2010 |
| CN | 201643679 | 11/2010 |
| CN | 201791361 | 4/2011 |
| CN | 201871231 | 6/2011 |
| DE | 20113208 | 1/2002 |
| ES | 1049907 | 1/2002 |
| GB | 2371496 A | 7/2002 |
| GB | 2371496 B | 1/2005 |
| HK | 1039025 | 3/2002 |
| JP | 9322984 | 12/1997 |
| WO | 9725118 | 7/1997 |
| WO | 2004043561 | 5/2004 |
| WO | 2006087527 | 8/2006 |
| WO | 2008002167 | 1/2008 |

OTHER PUBLICATIONS

Turbo Tower-Actionpack, Simba—Brands & Products Webpage (http://www.simbatoys.de/en/brands_products/games_more/action/detail.shtml?sArtNr=106044522) (retrieved Jul. 22, 2009).

"Crayola Glow Station and Crayola Color Surge Win Coveted Platinum Award from the Oppenheim Toy Portfolio," Crayola Press Release (Oct. 7, 2008).

CrayolaStore.Com: Crayola Glow Station Product Description (circa 2008).

Invitation to Pay Additional Fees mailed Jun. 8, 2010 in PCT Application No. PCT/IB2009/007779.

International Search Report and Written Opinion, mailed Sep. 17, 2010, from PCT Application No. PCT/IB2009/007779.

International Preliminary Report on Patentability (including Written Opinion of the ISA) mailed Jul. 7, 2011 in International Application No. PCT/IB2009/007779.

Chinese Office Action issued Sep. 11, 2012 in Chinese Patent Application No. 200910260584.5 and English translation thereof.

* cited by examiner

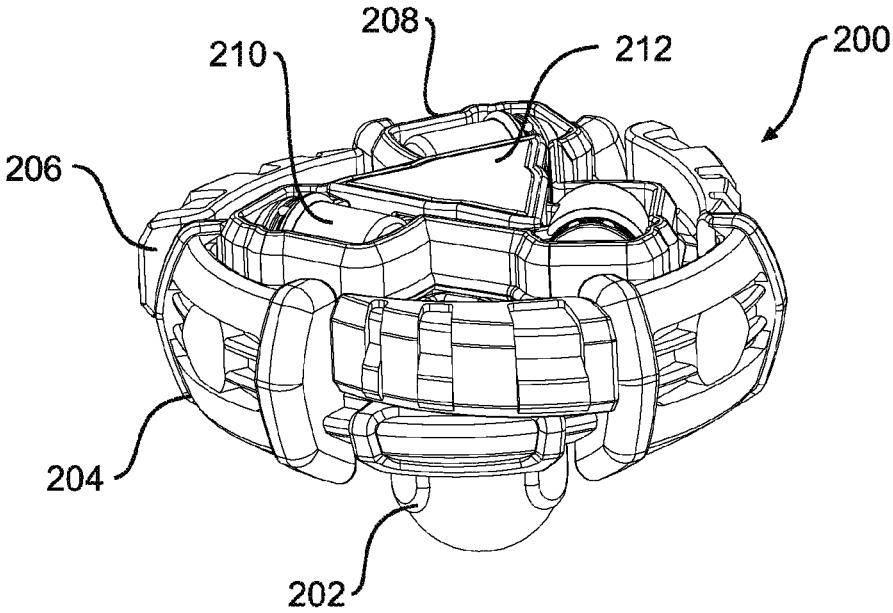
FIG. 2.1
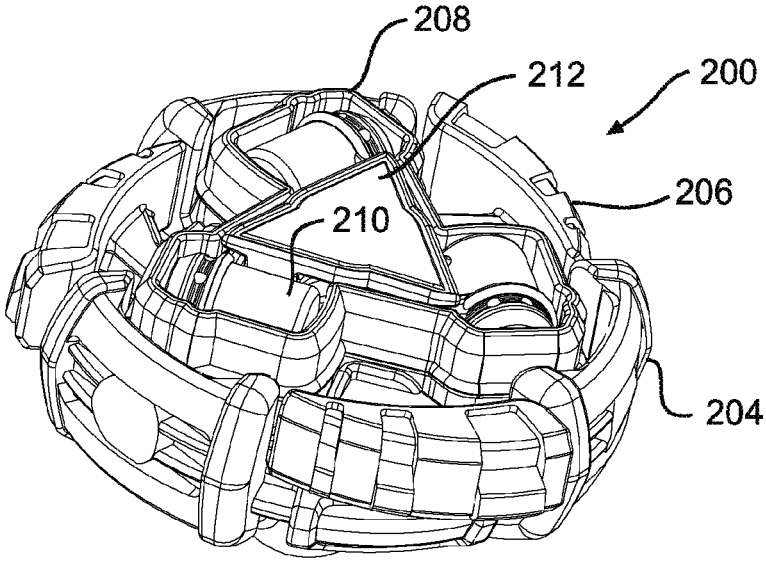
FIG. 2.2

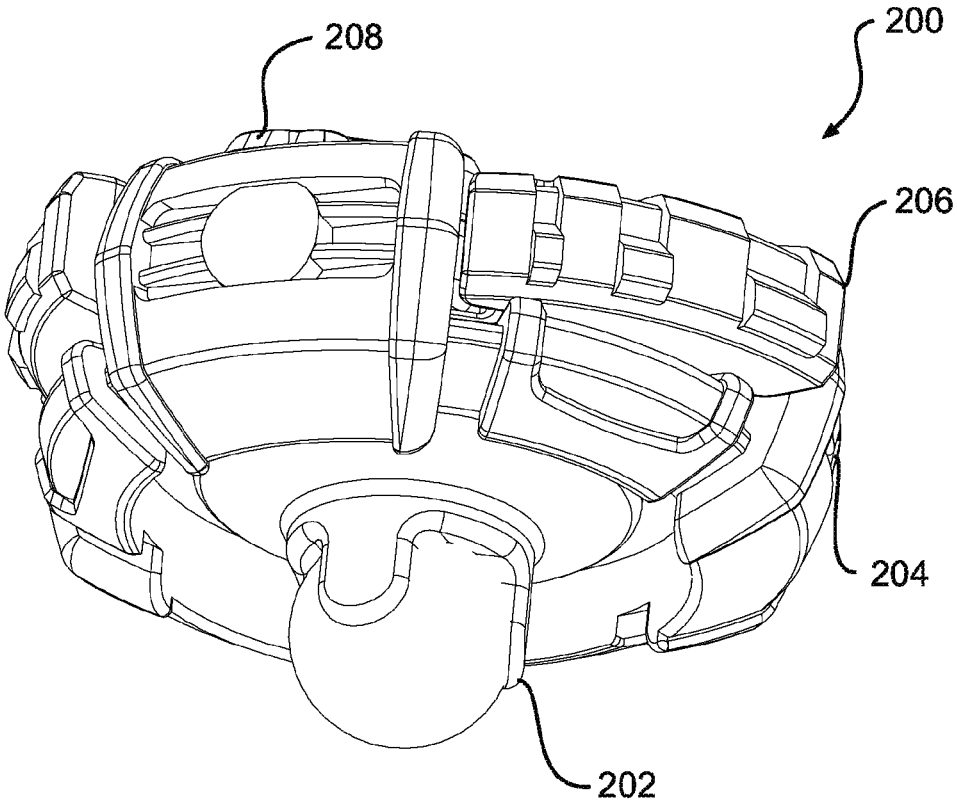
FIG. 2.3

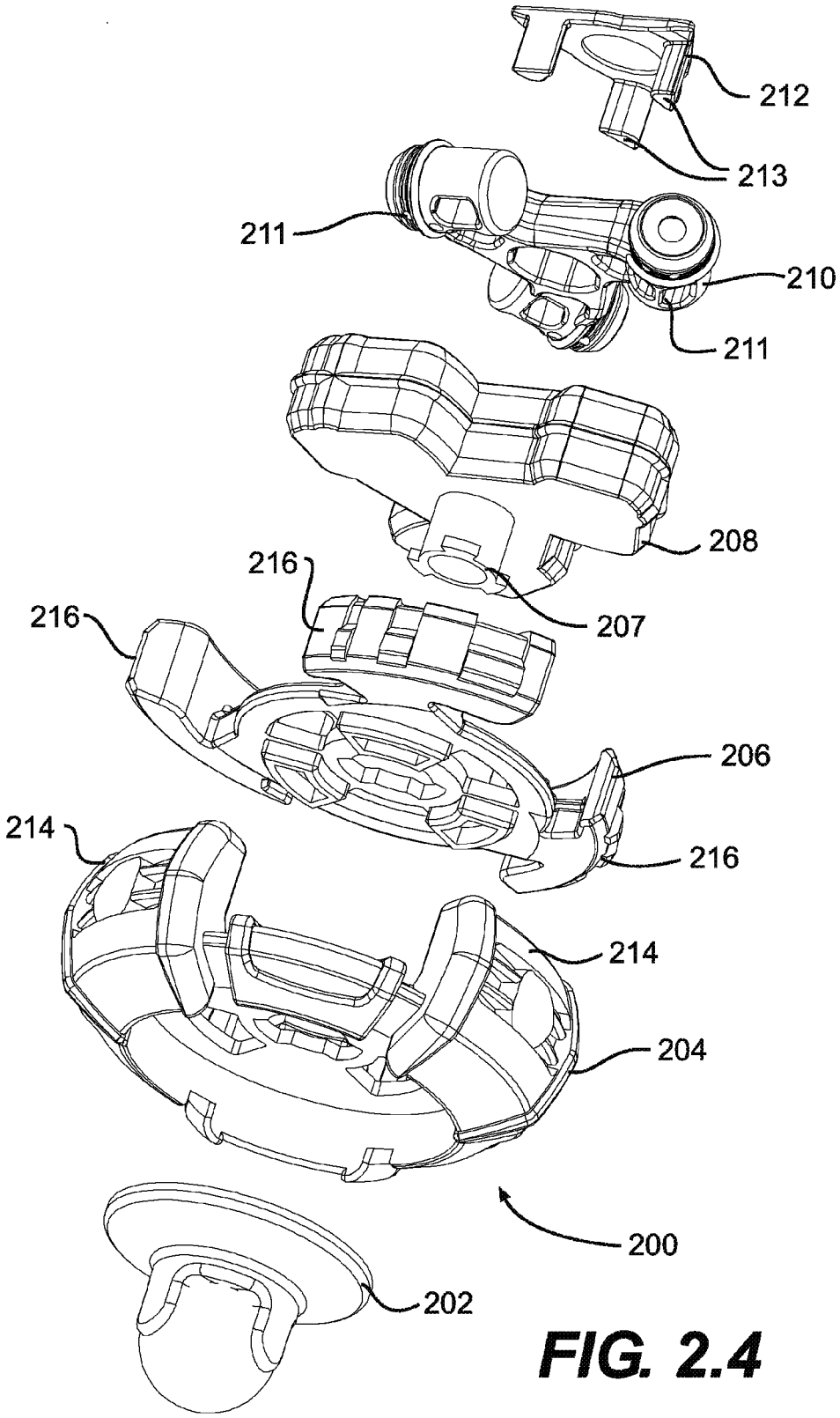
FIG. 2.4

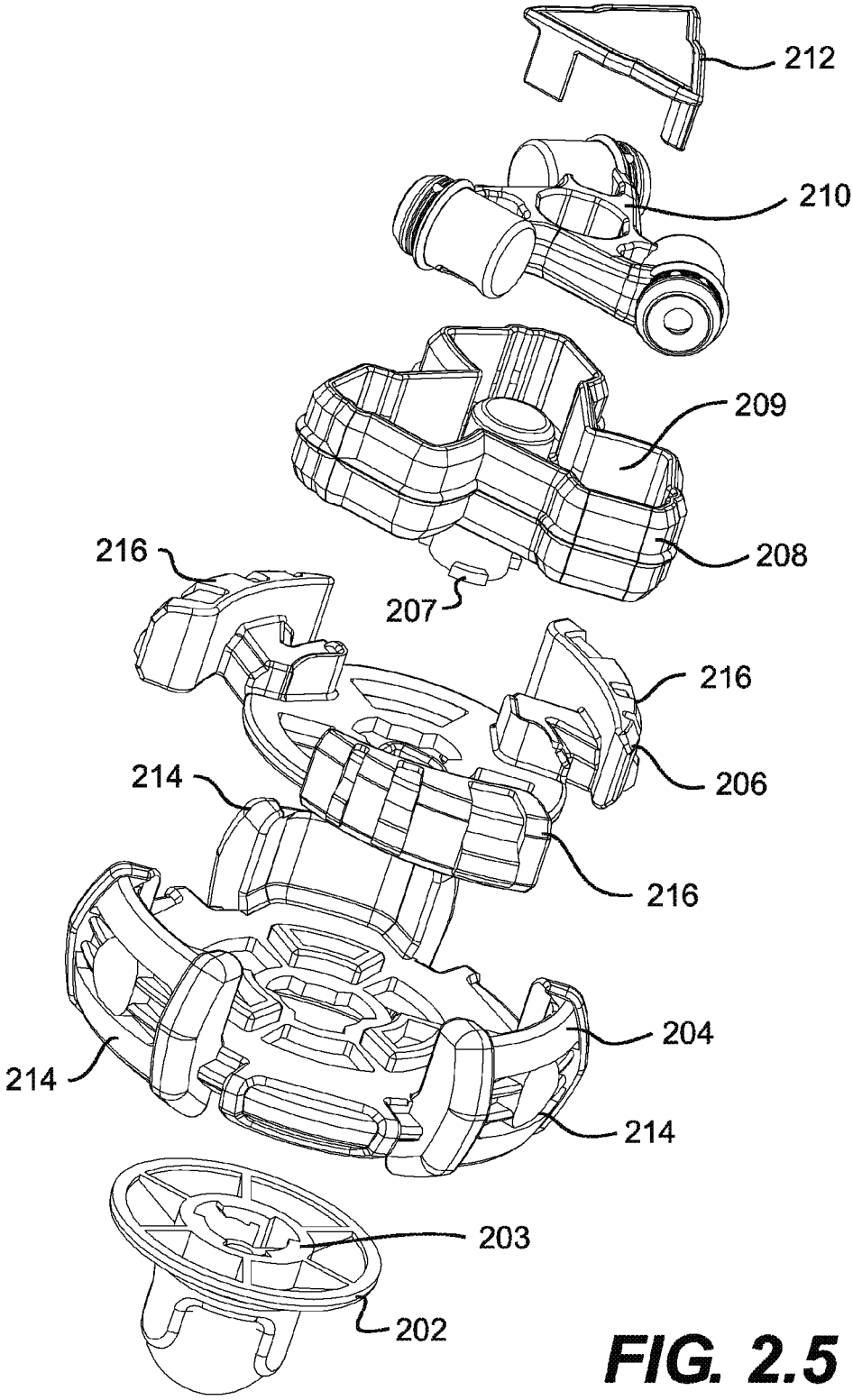
FIG. 2.5

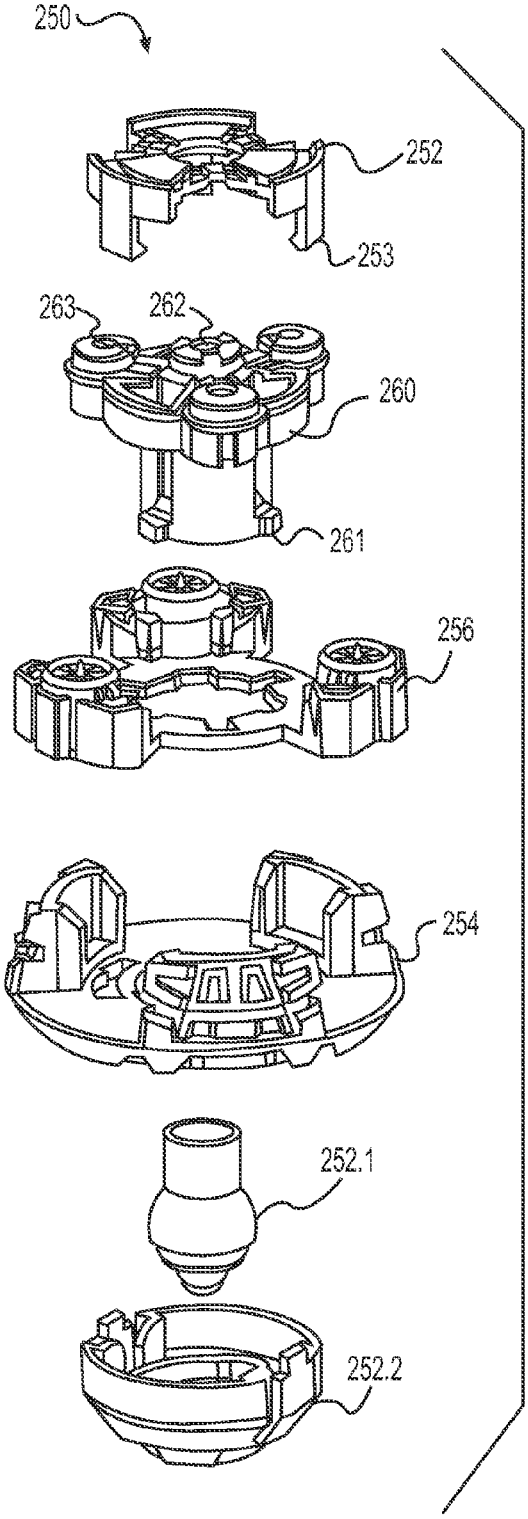
FIG. 2.7
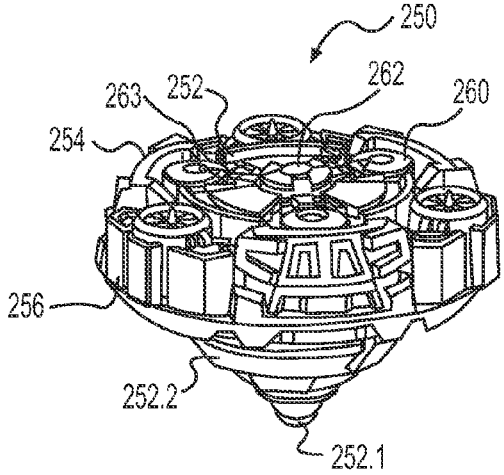
FIG. 2.6

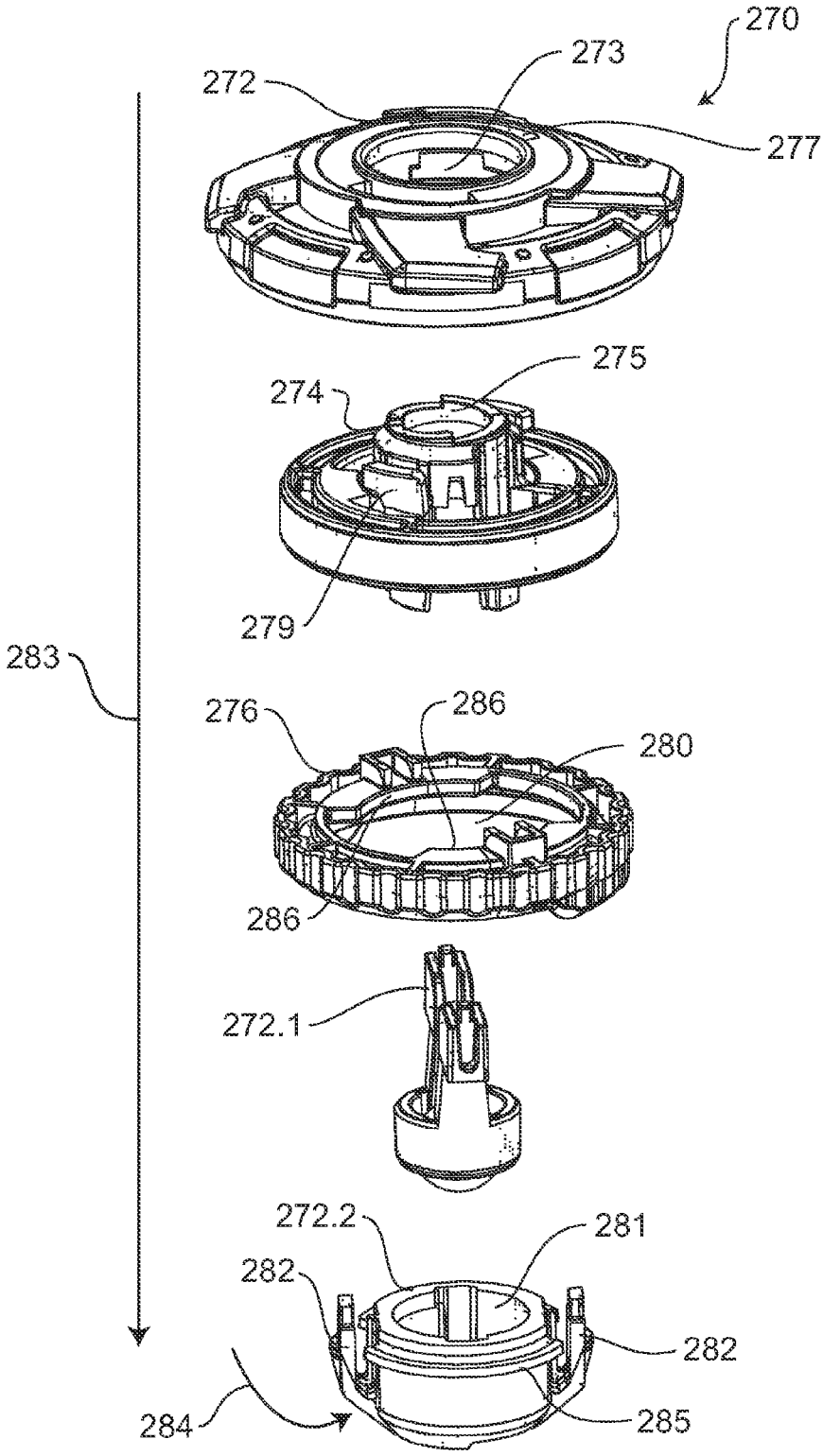
FIG. 2.8

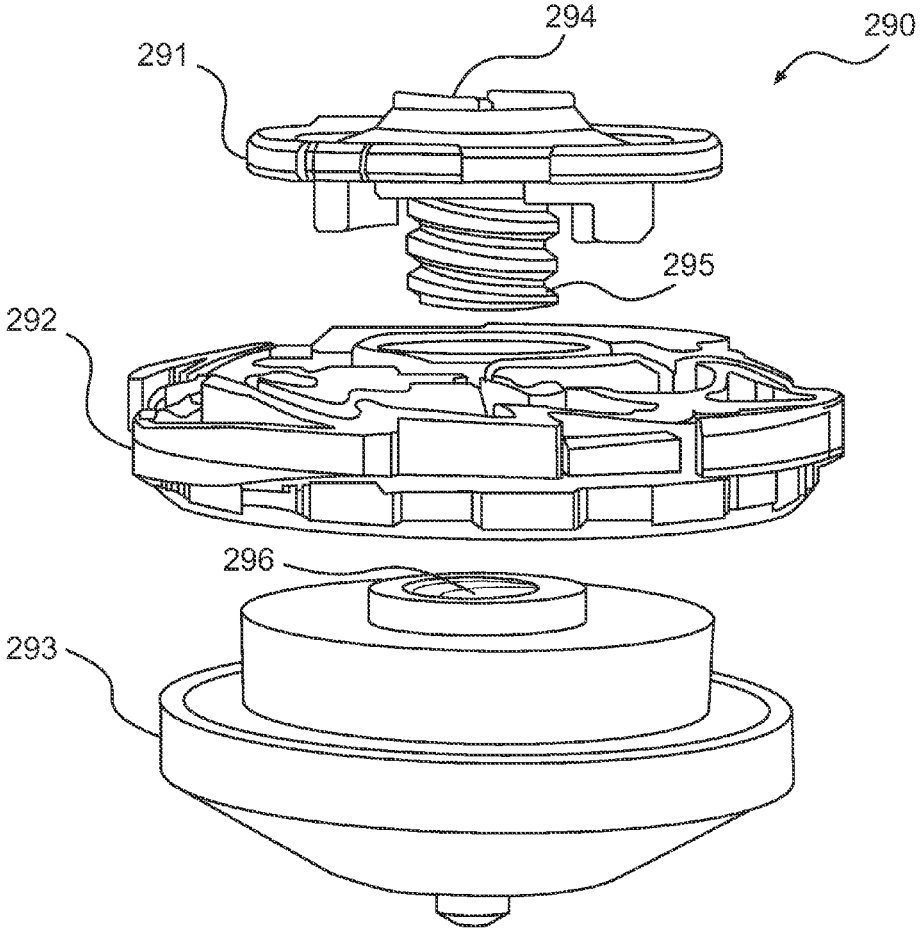
FIG. 2.9
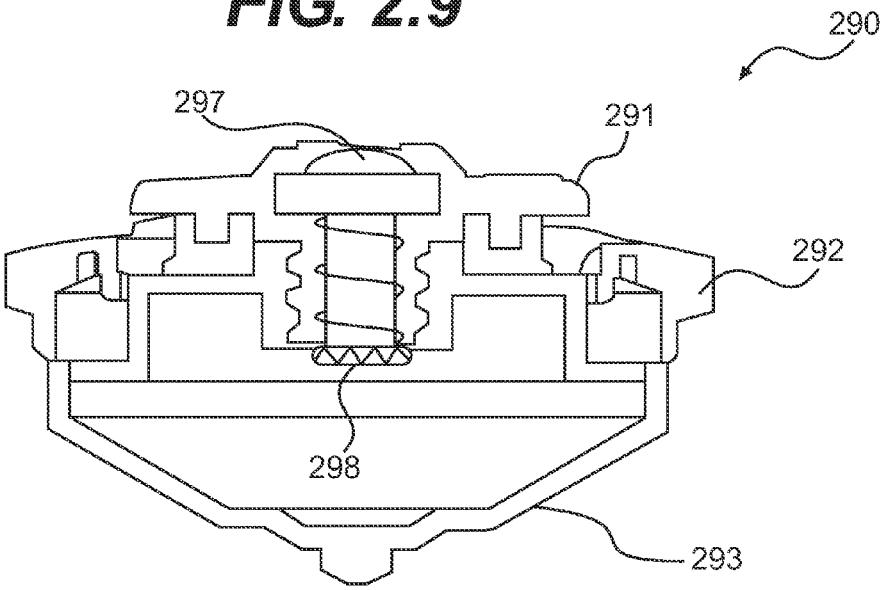
FIG. 2.10

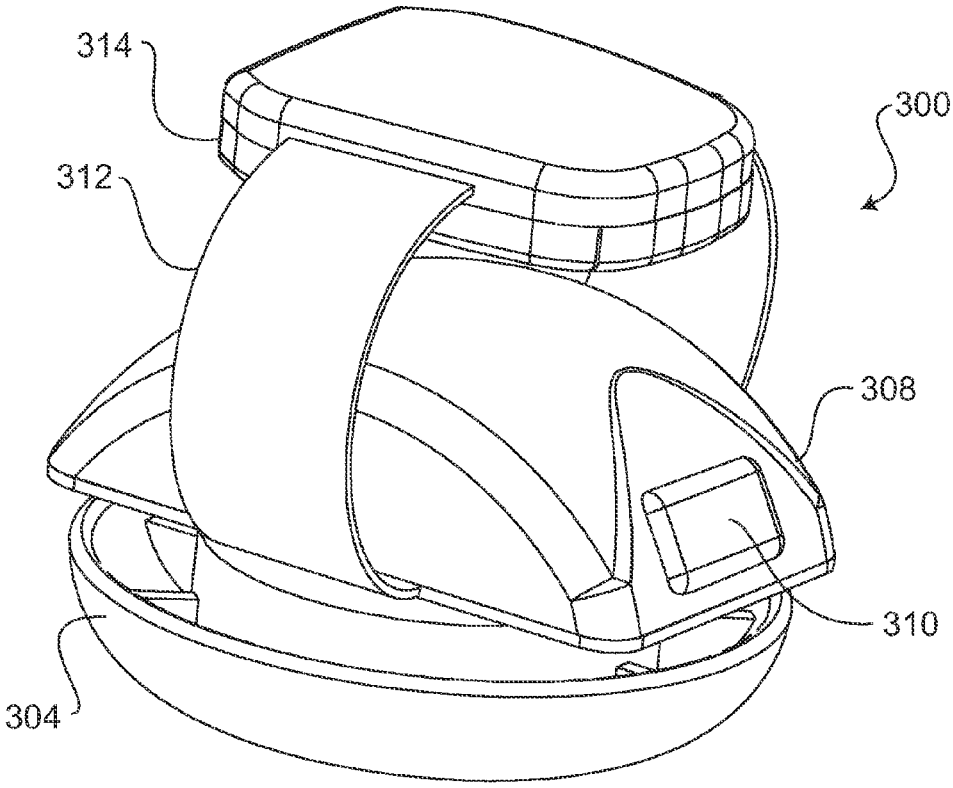
FIG. 3.1

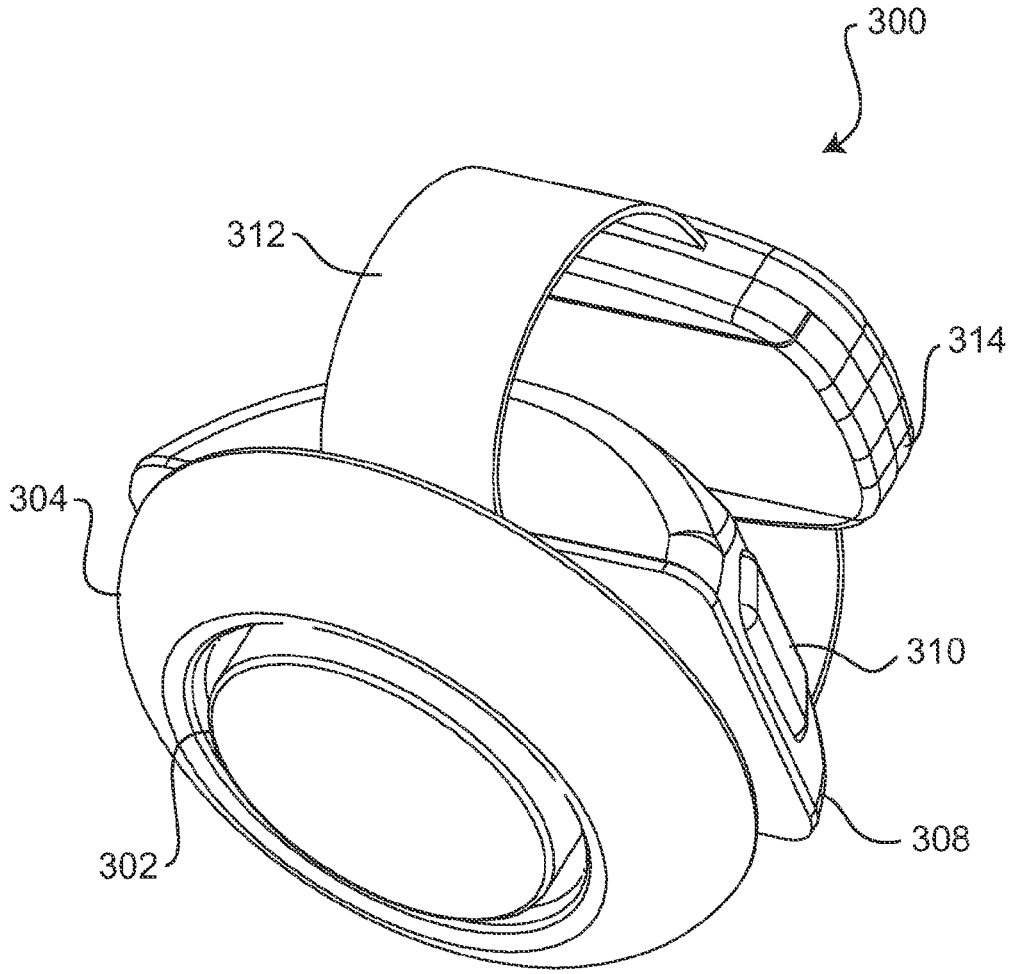
FIG. 3.2

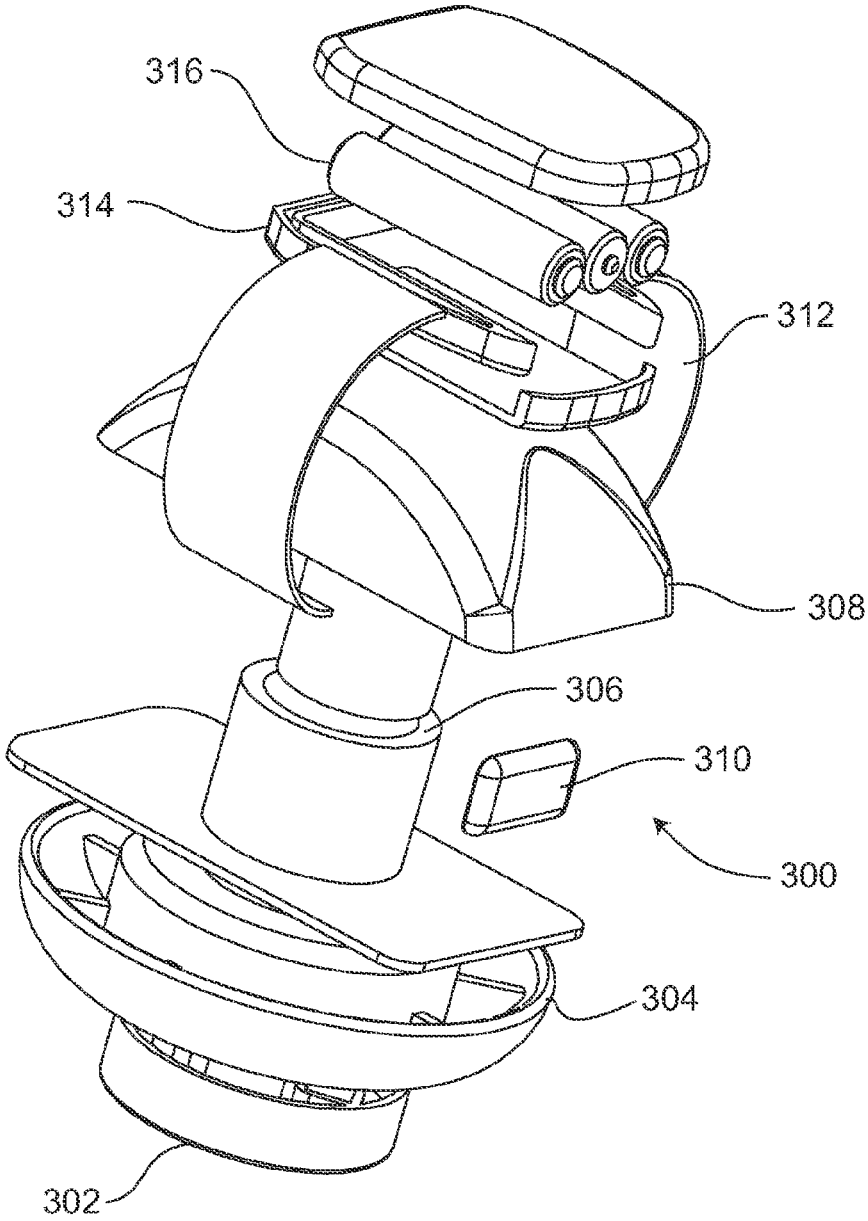
FIG. 3.3

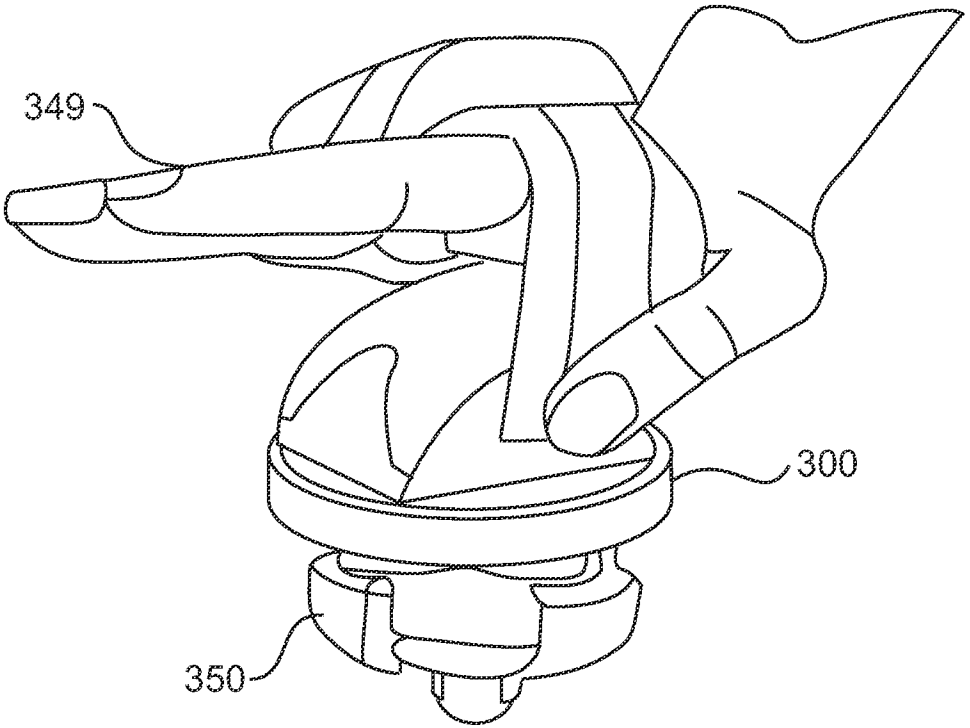
FIG. 3.4

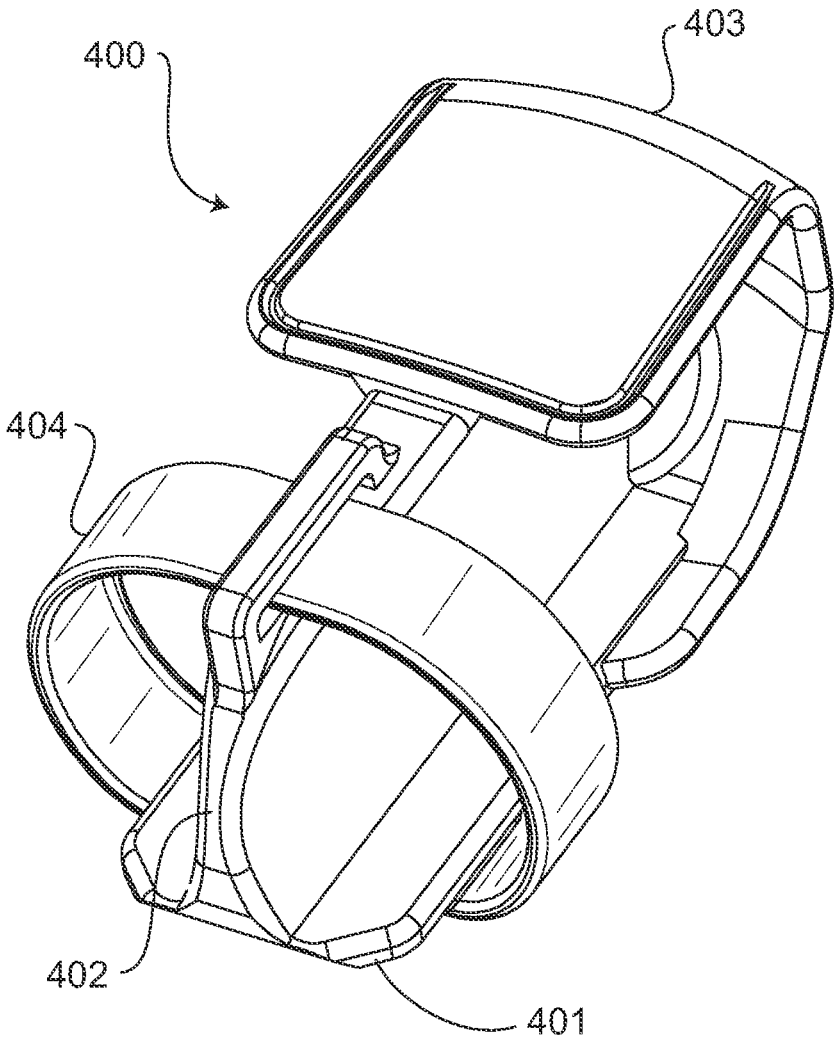
FIG. 4.1

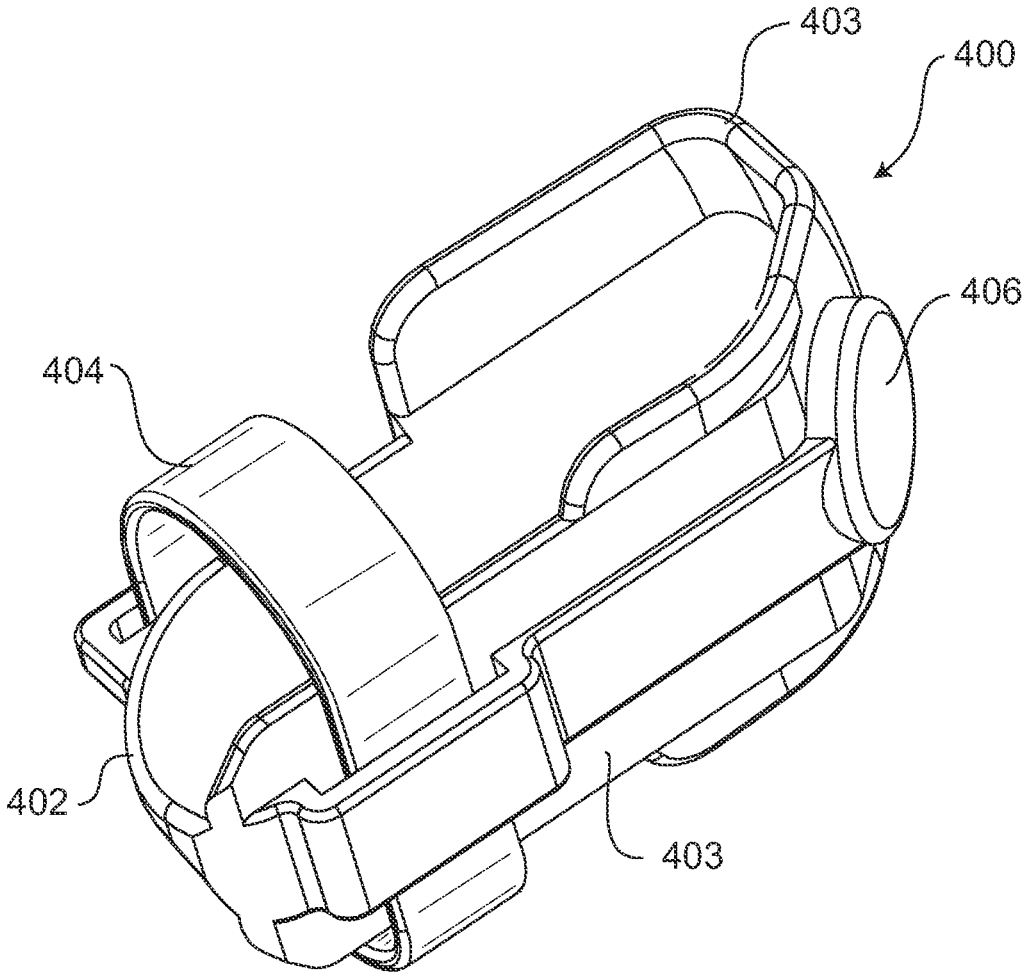
FIG. 4.2

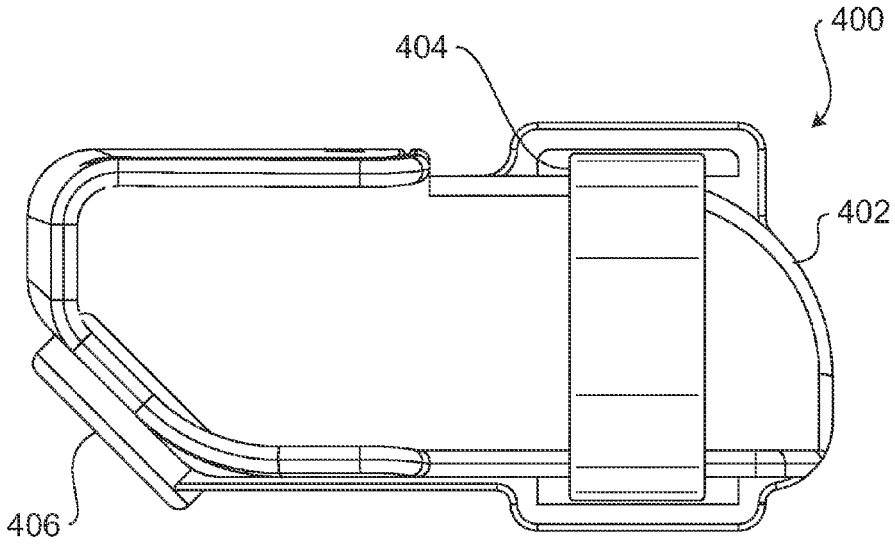
FIG. 4.3

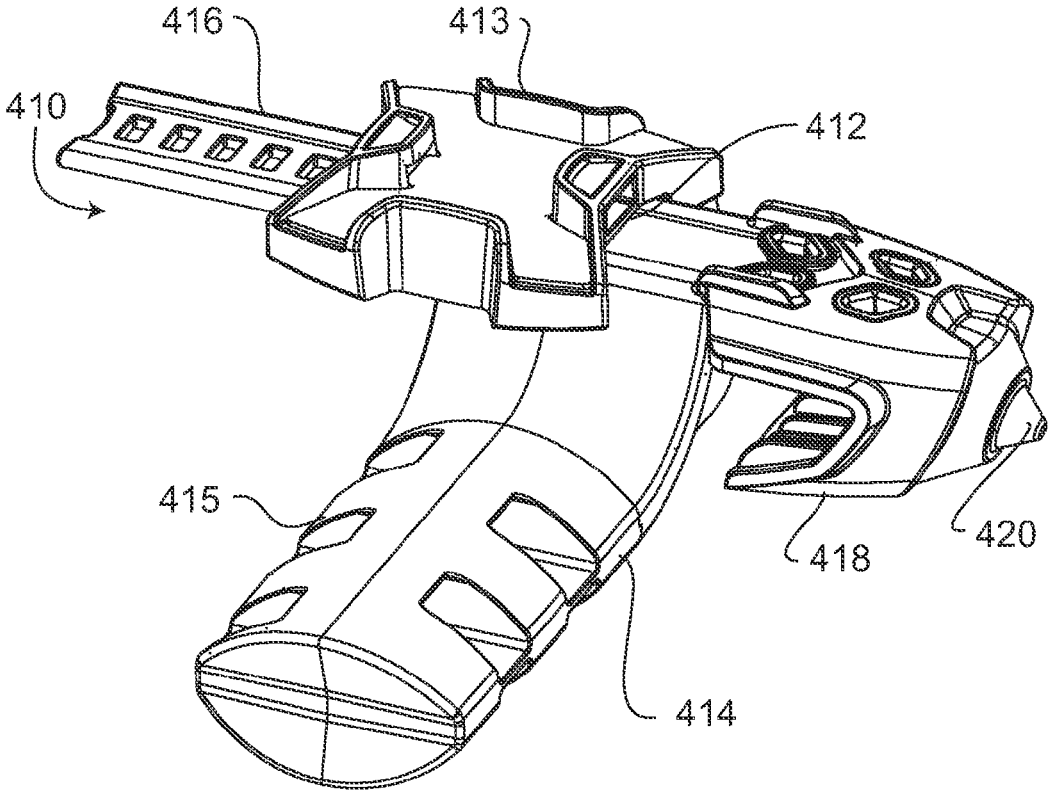
FIG. 4.4

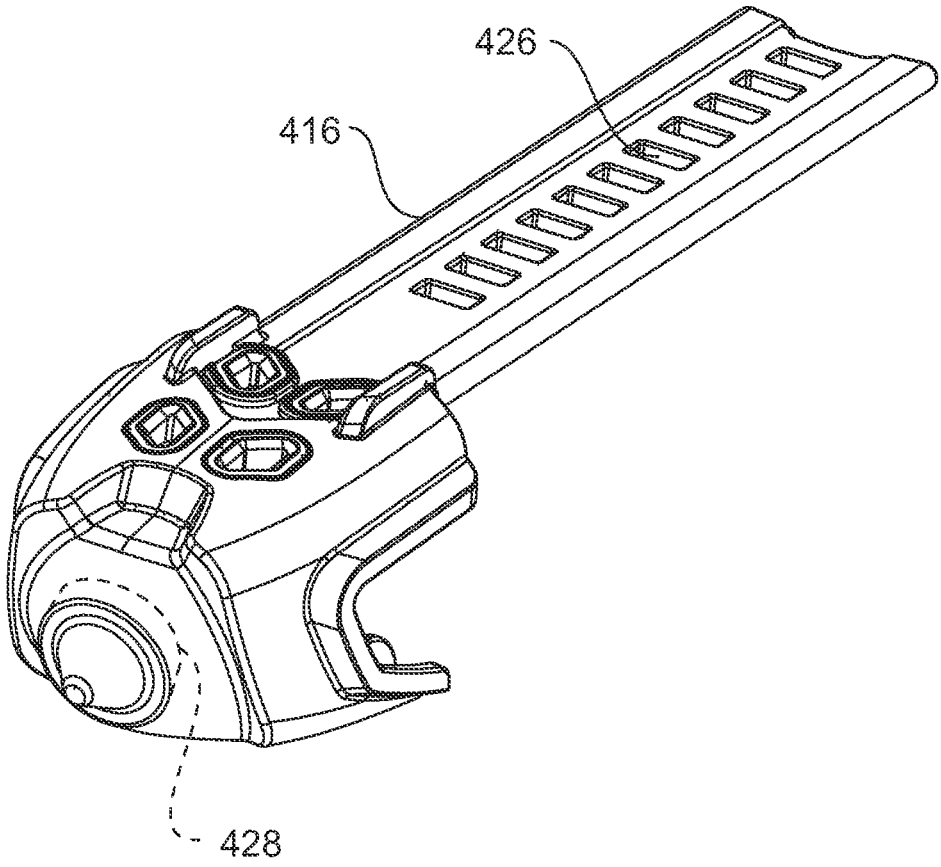
FIG. 4.5

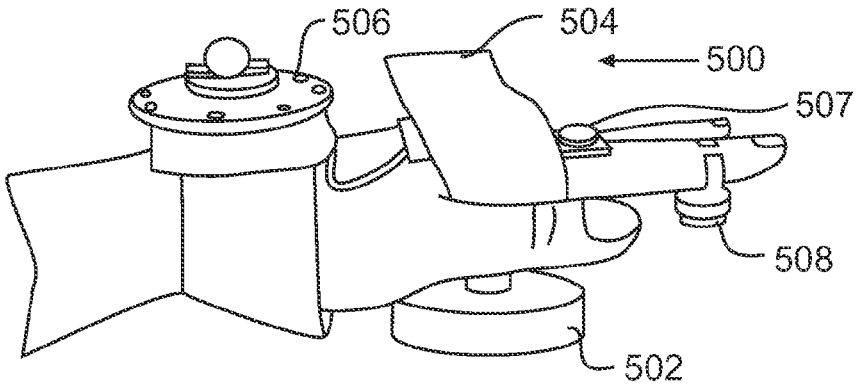
FIG. 5.1
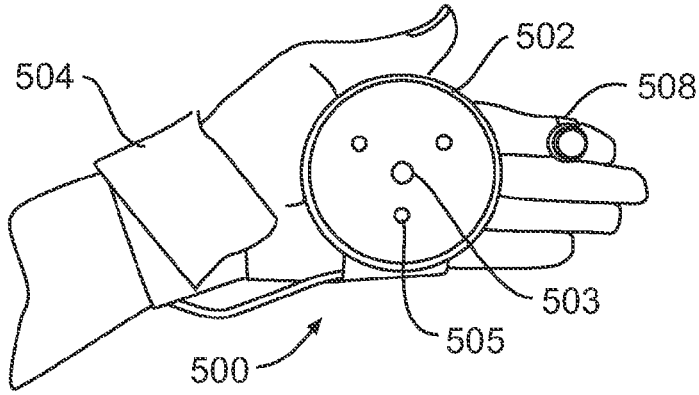
FIG. 5.2
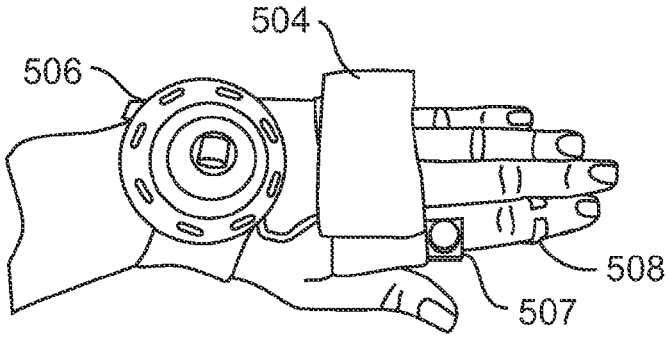
FIG. 5.3

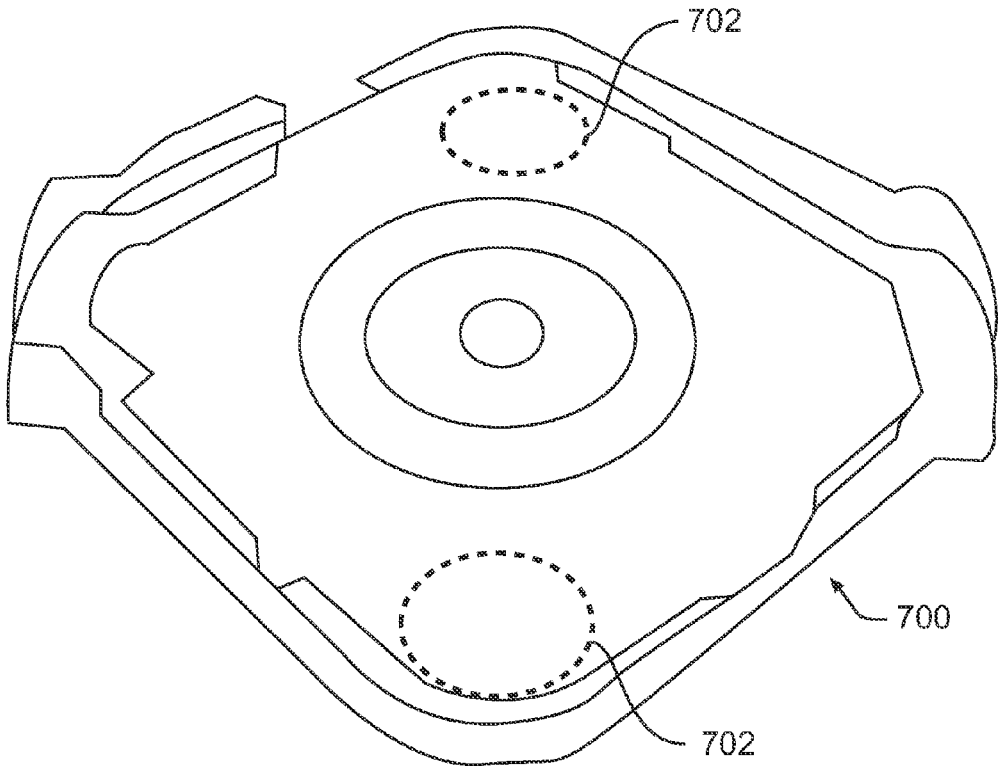
FIG. 7.1

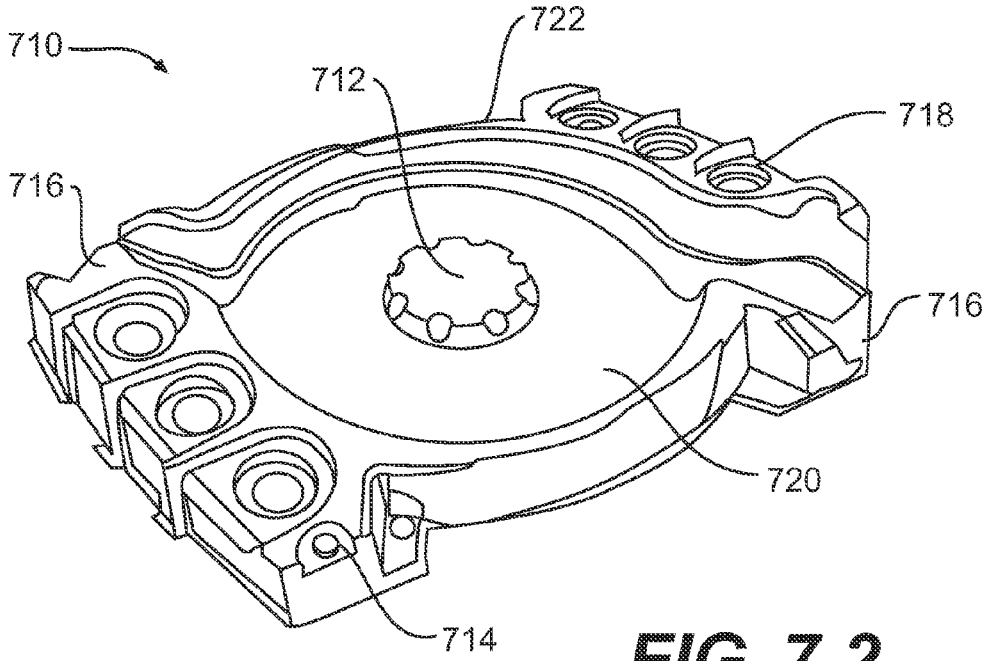
FIG. 7.2
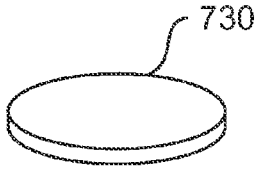
FIG. 7.3
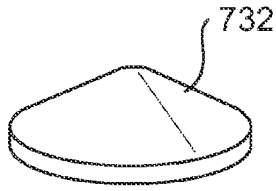
FIG. 7.4
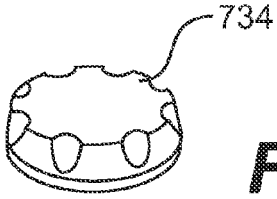
FIG. 7.5

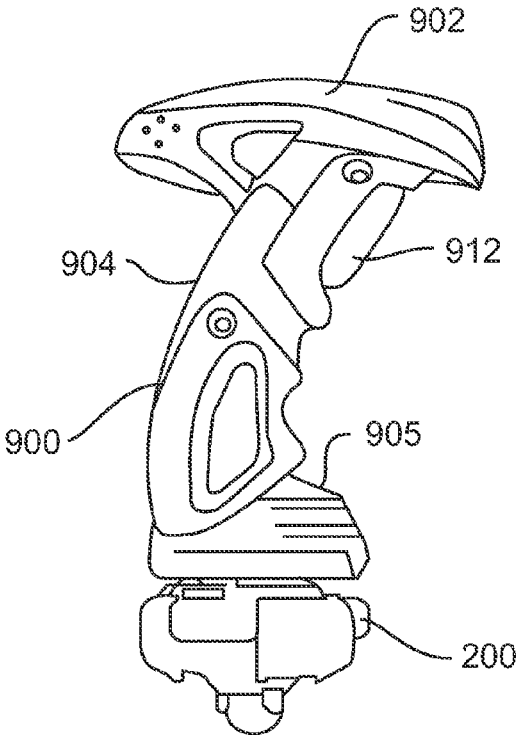
FIG. 9.1
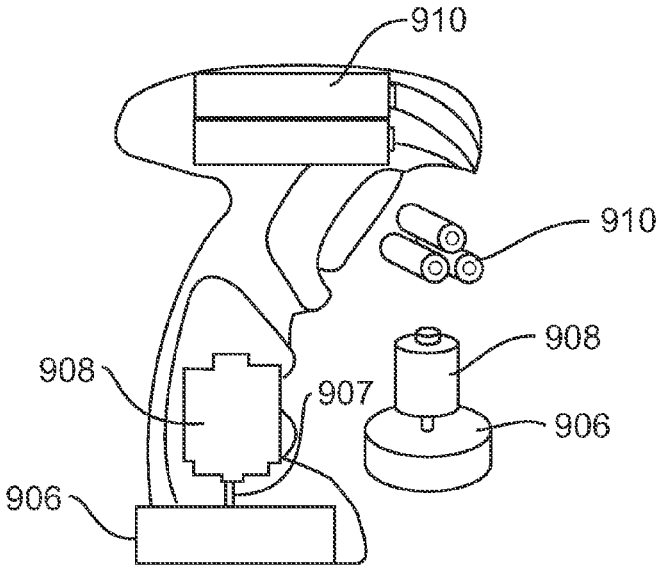
FIG. 9.2

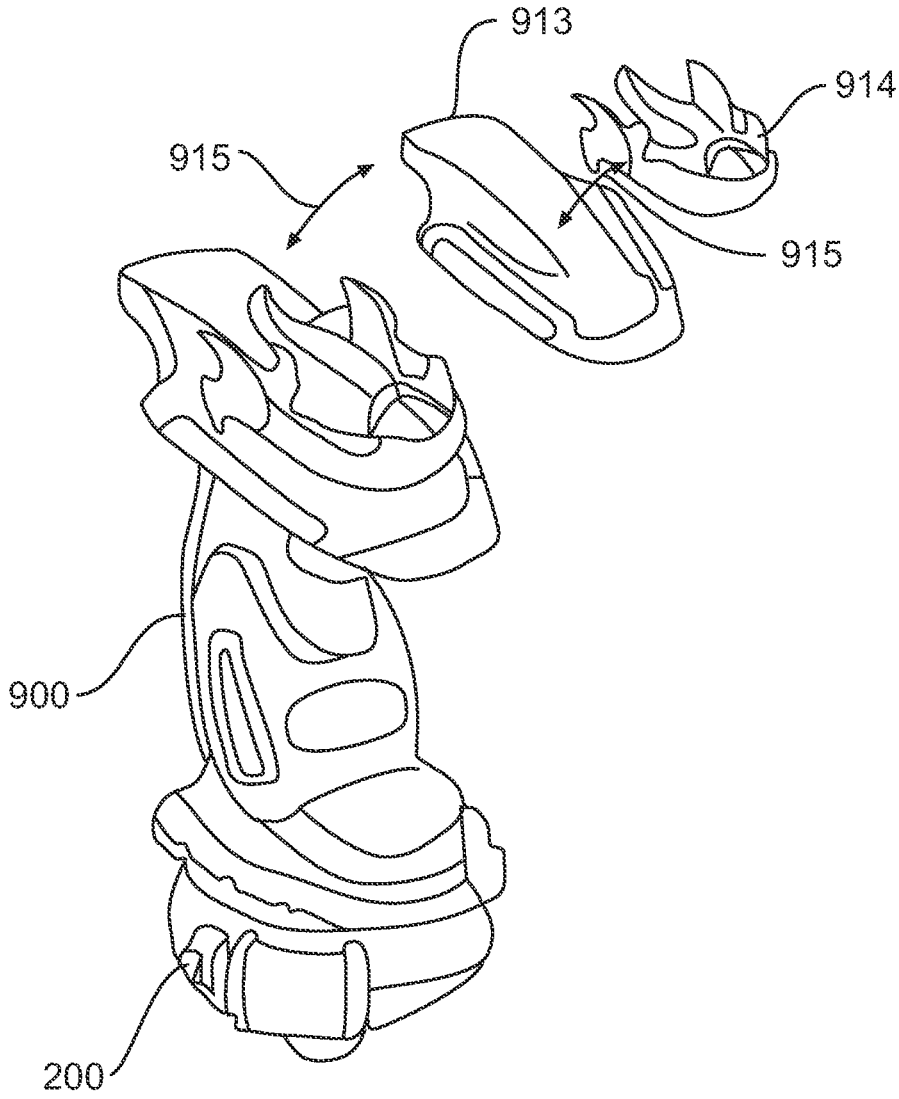
FIG. 9.3

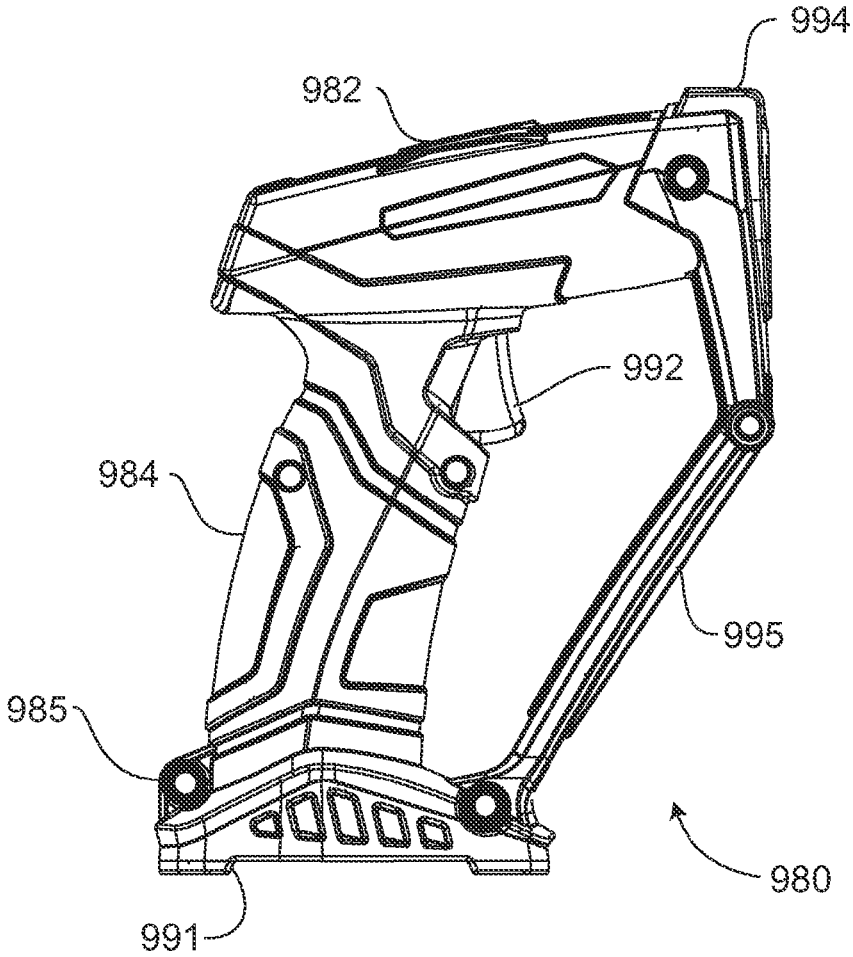
FIG. 9.4

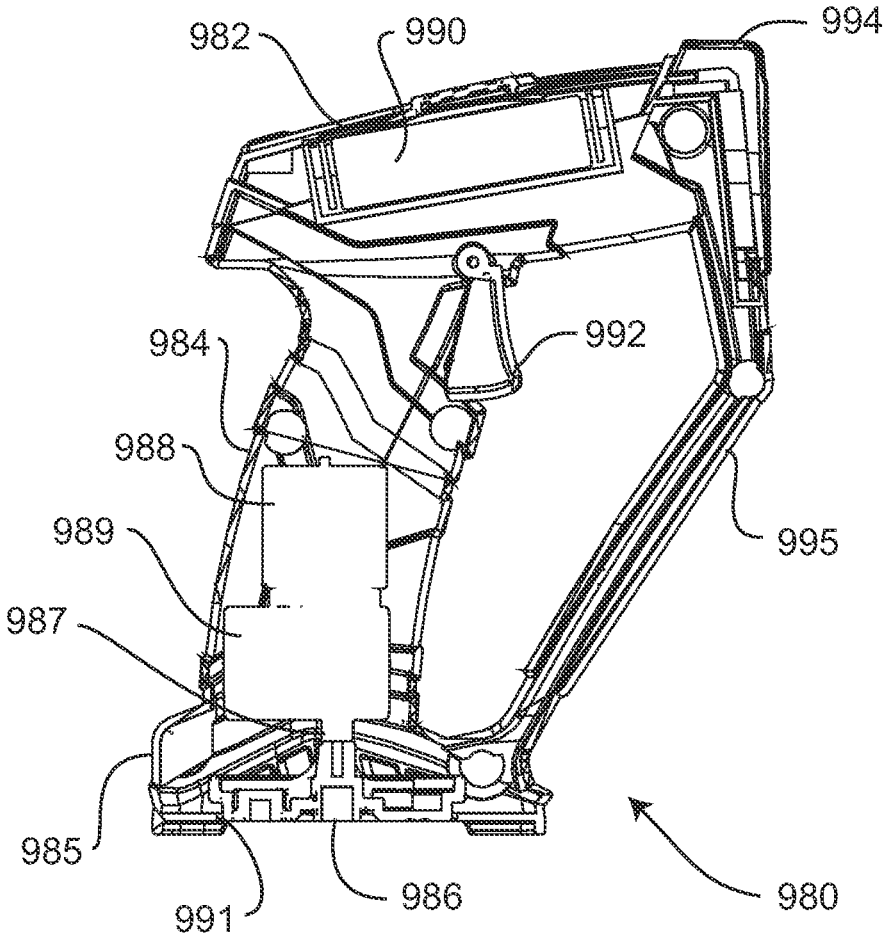
FIG. 9.5

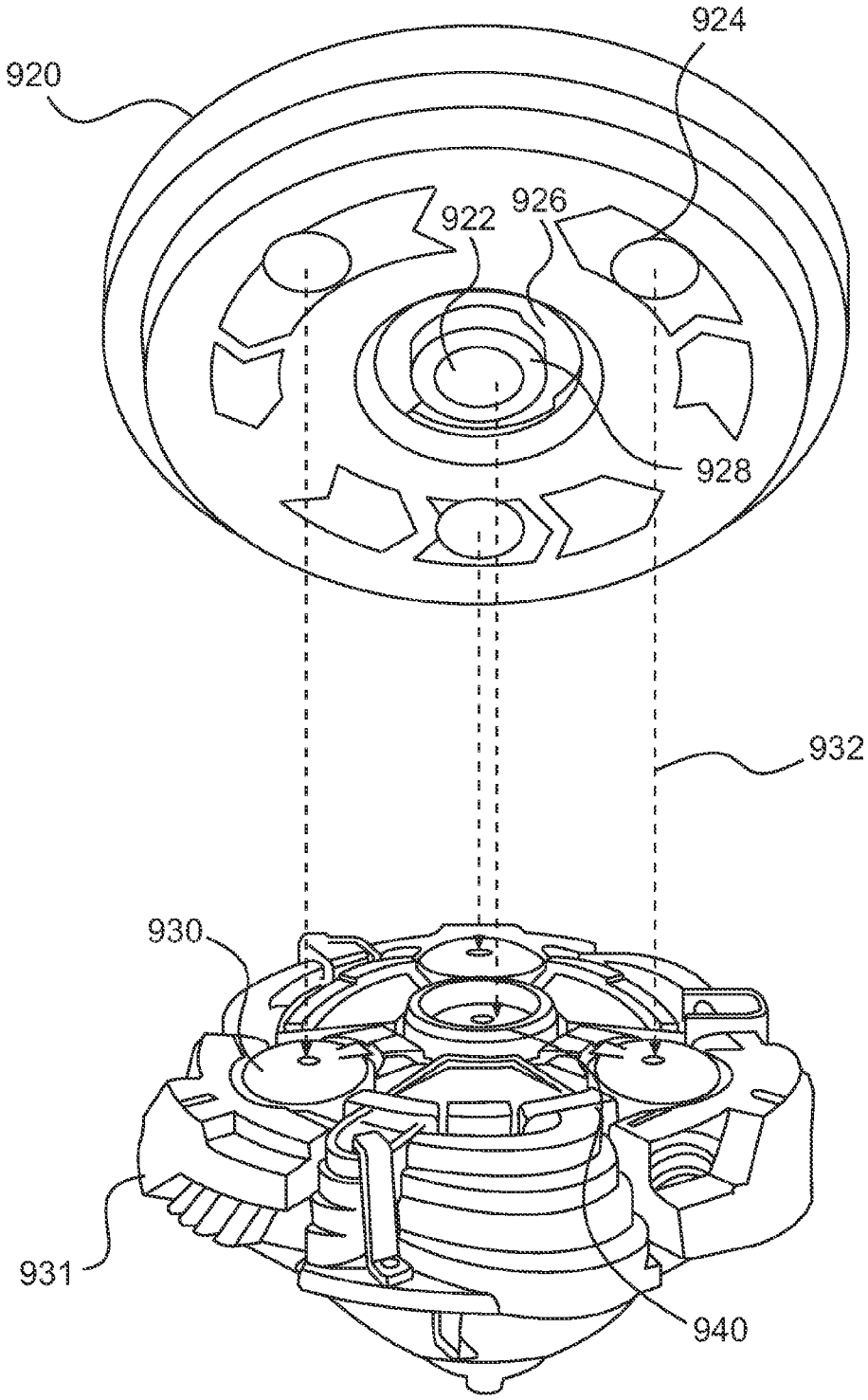
FIG. 9.6

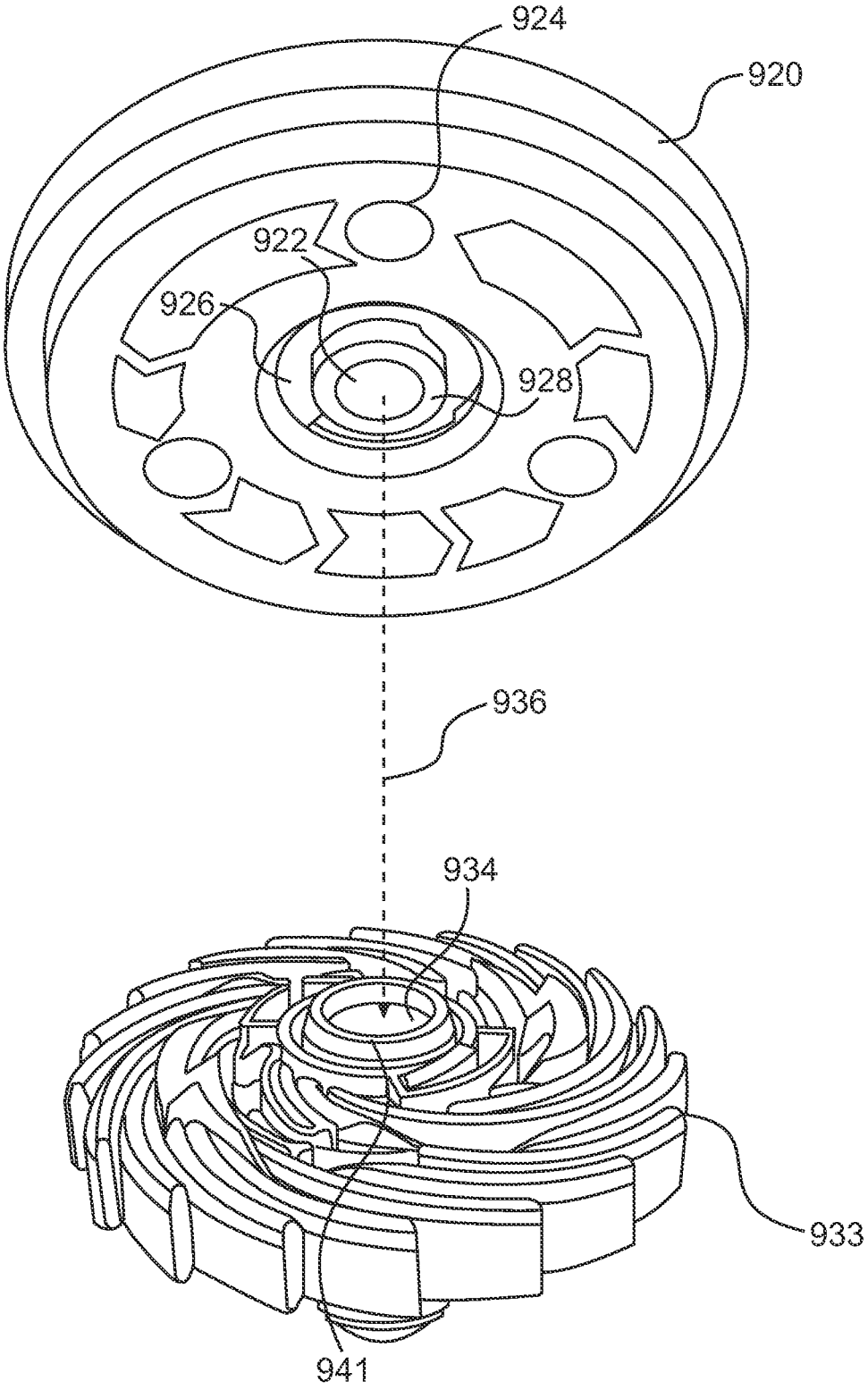
FIG. 9.7

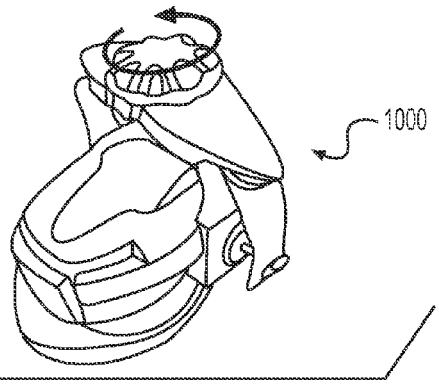
FIG. 10.1
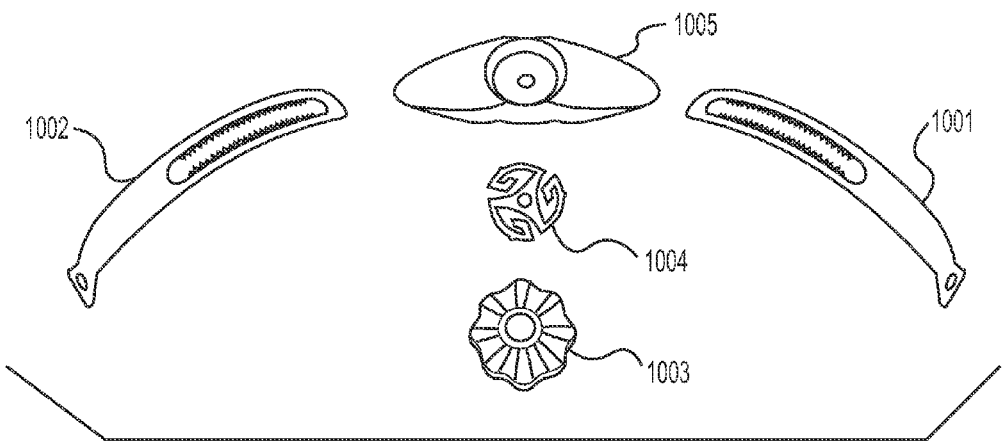
FIG. 10.2
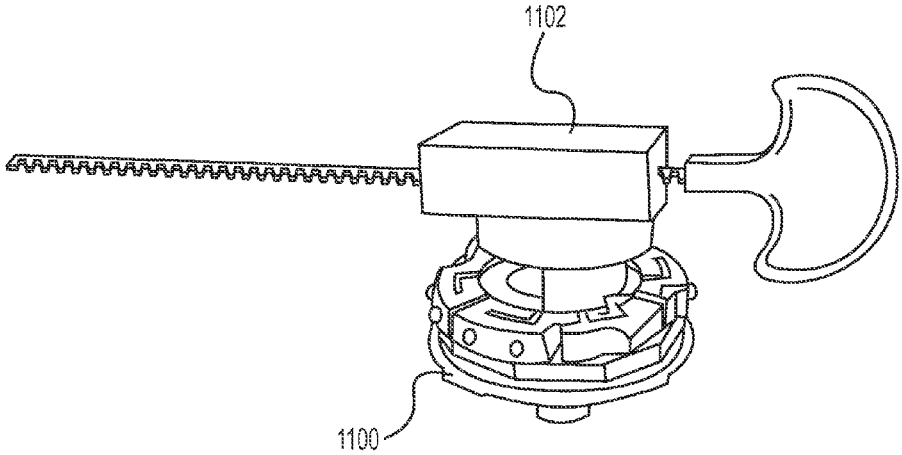
FIG. 11

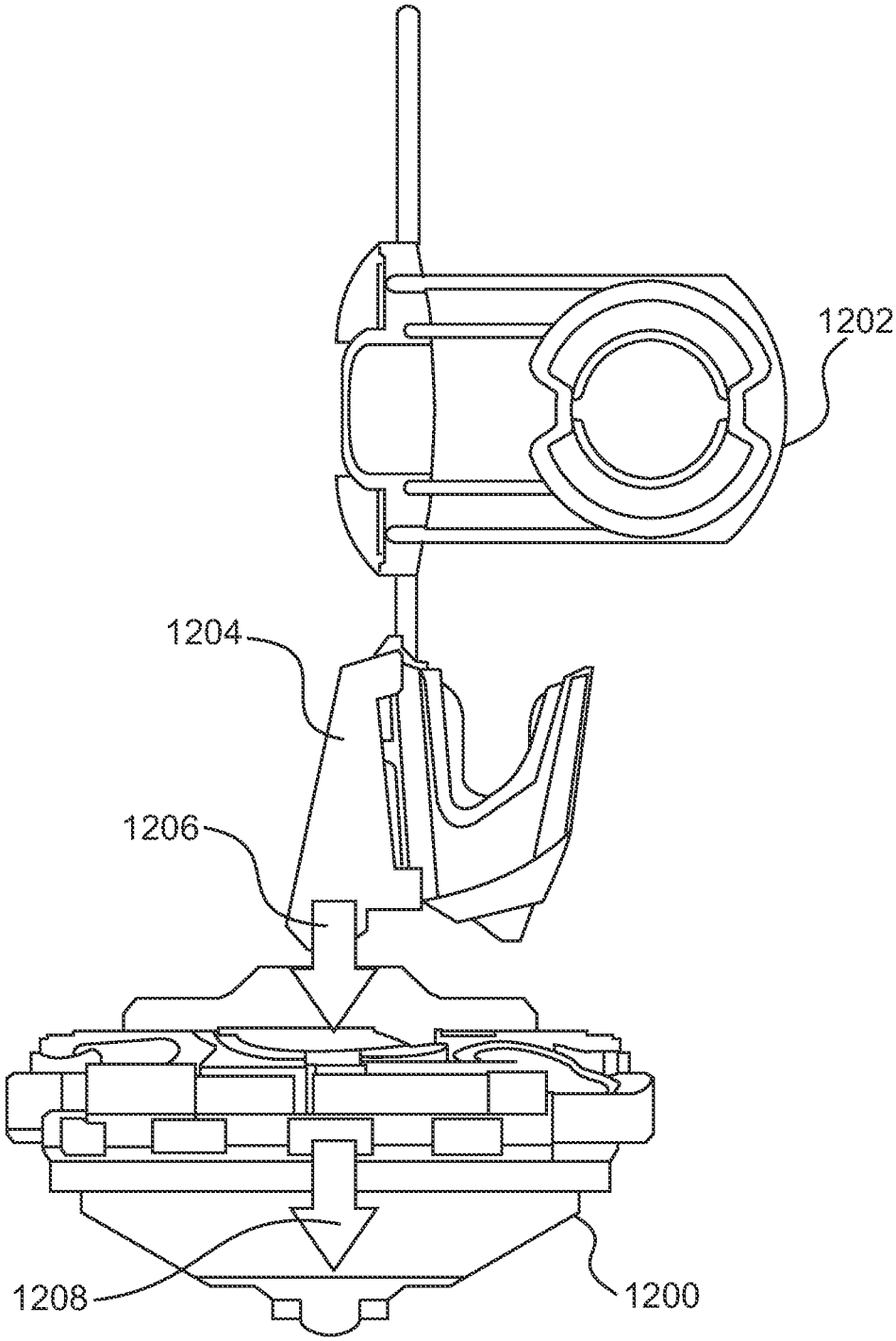
FIG. 12.1

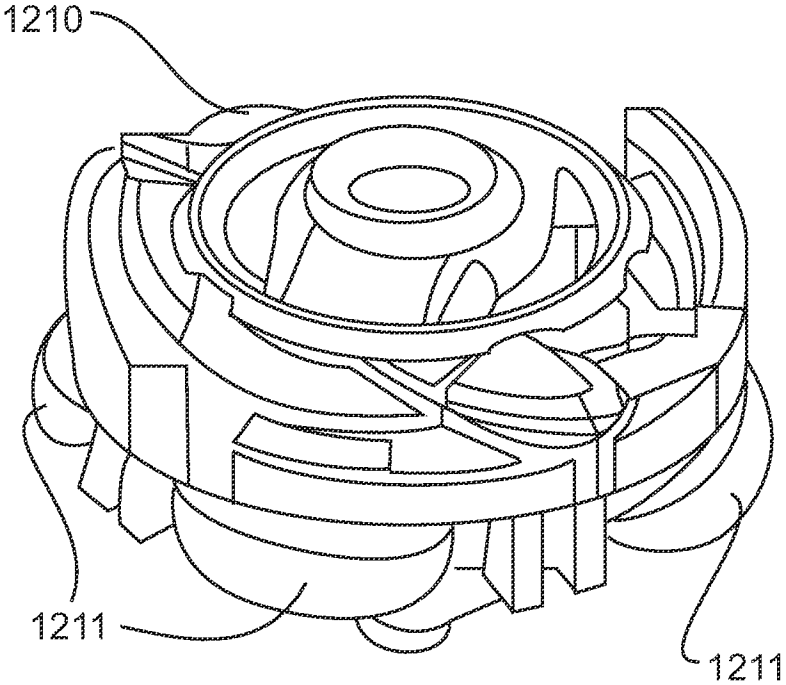
FIG. 12.2

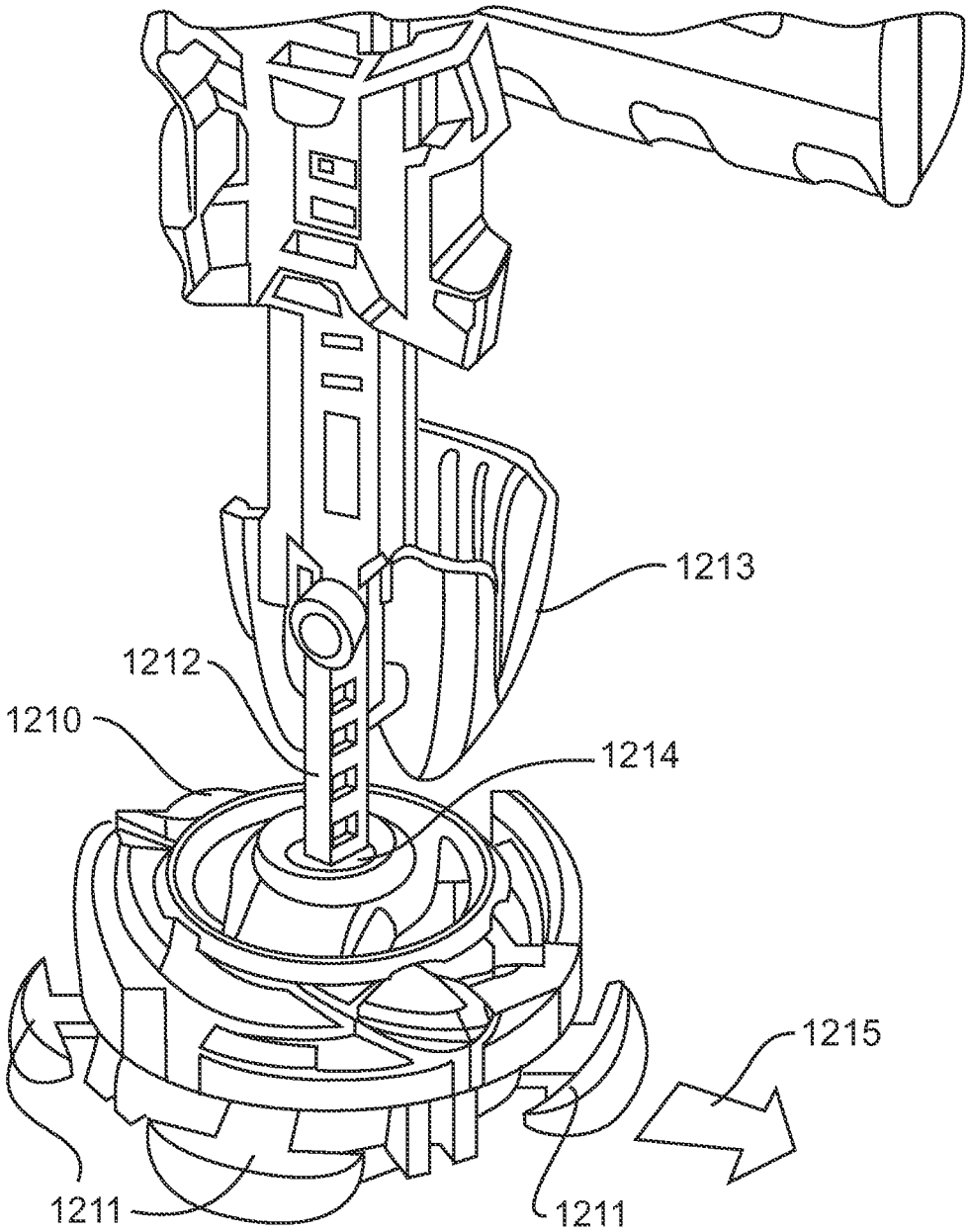
FIG. 12.3

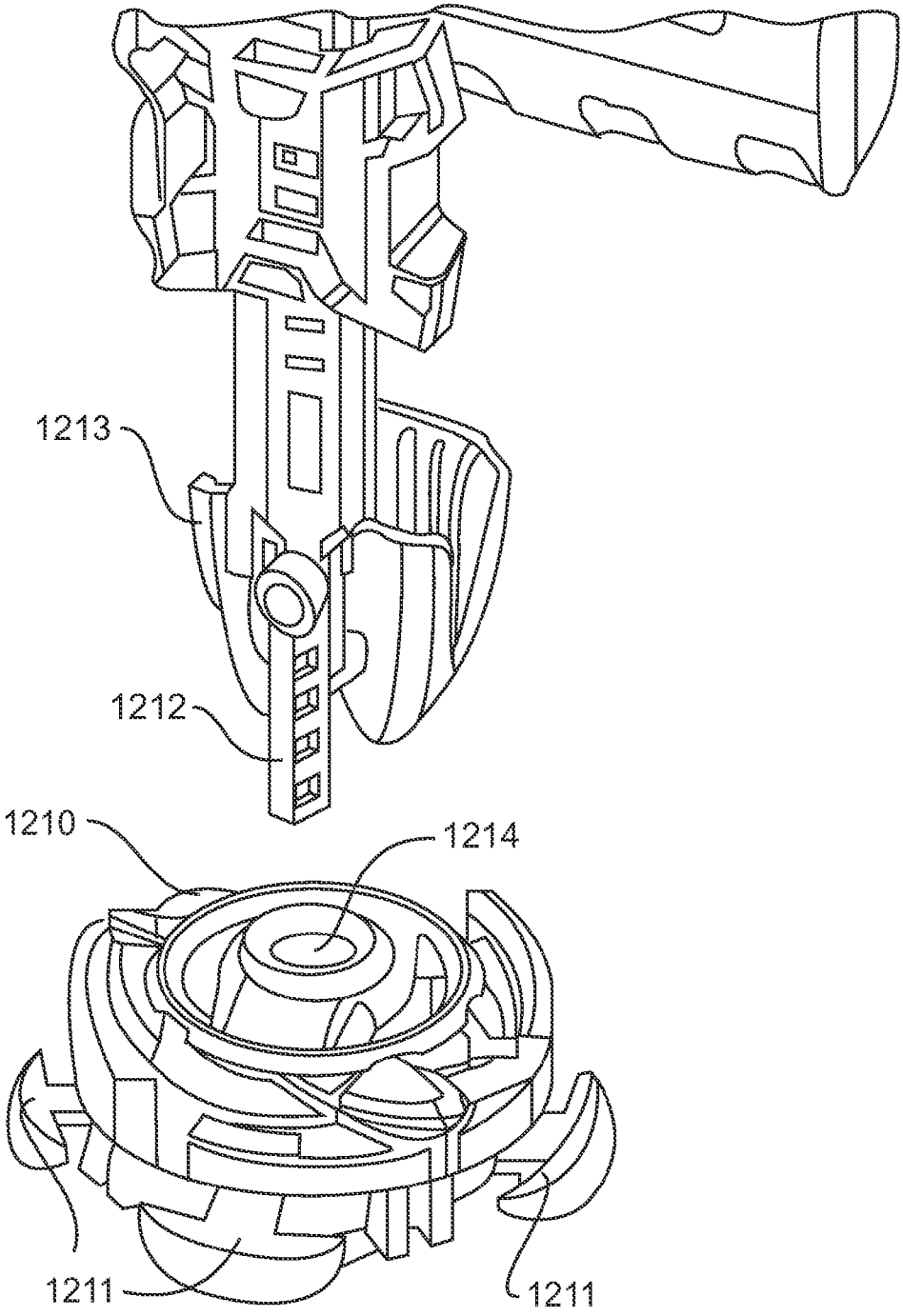
FIG. 12.4

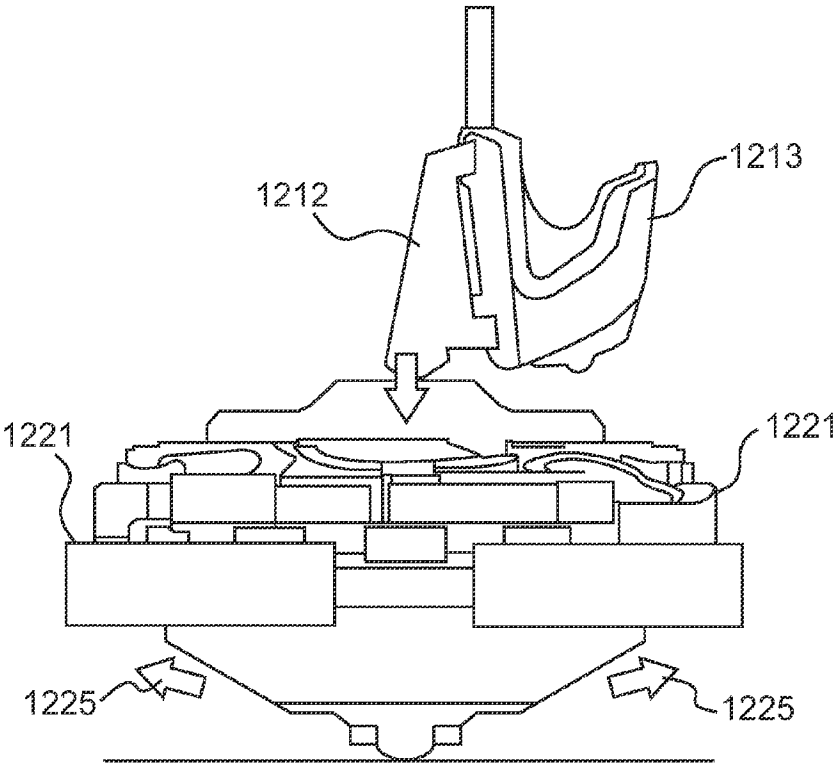
FIG. 12.6
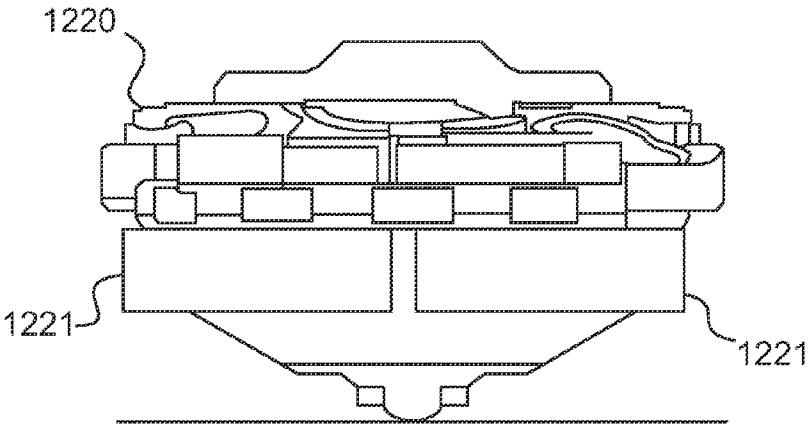
FIG. 12.5

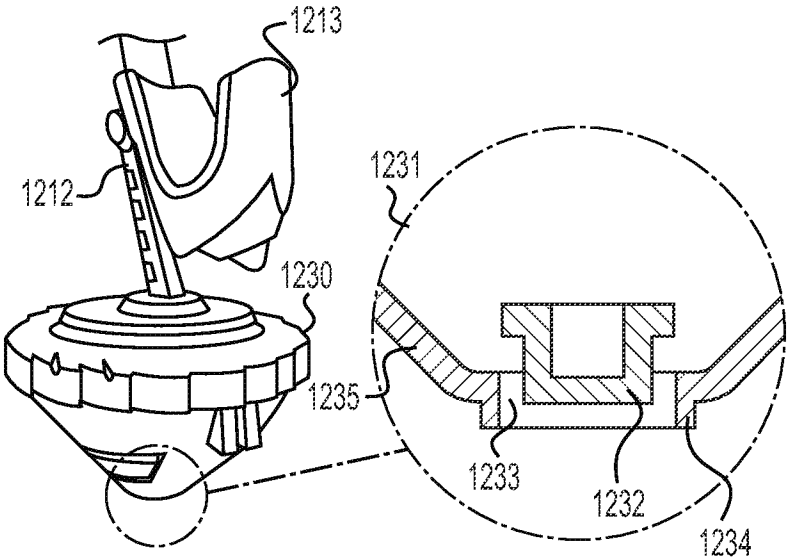
FIG. 12.8
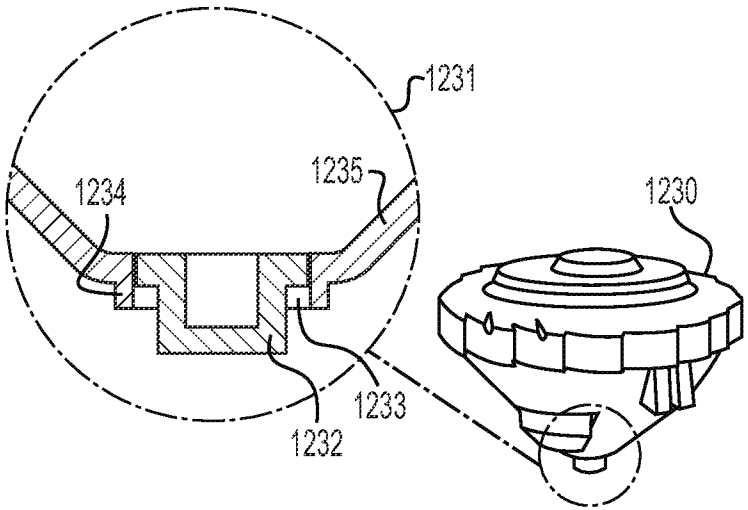
FIG. 12.7

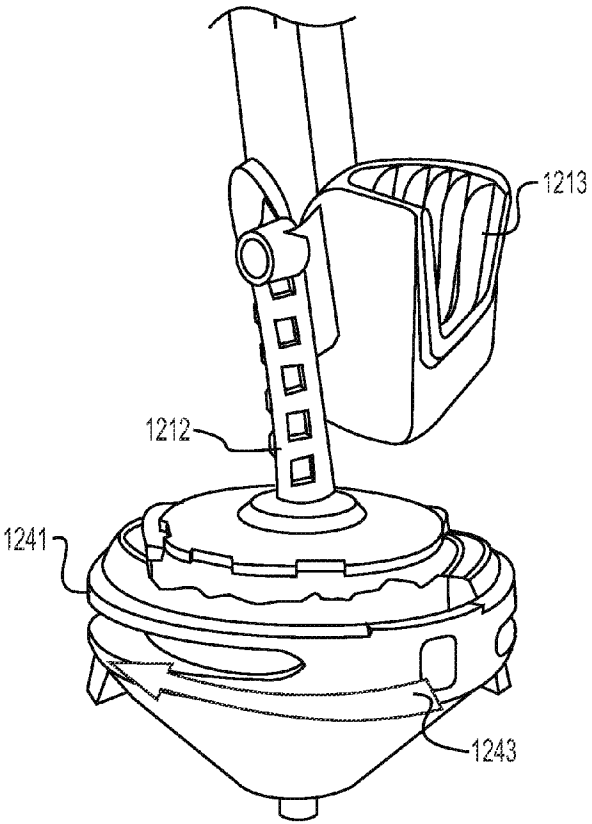
FIG. 12.10
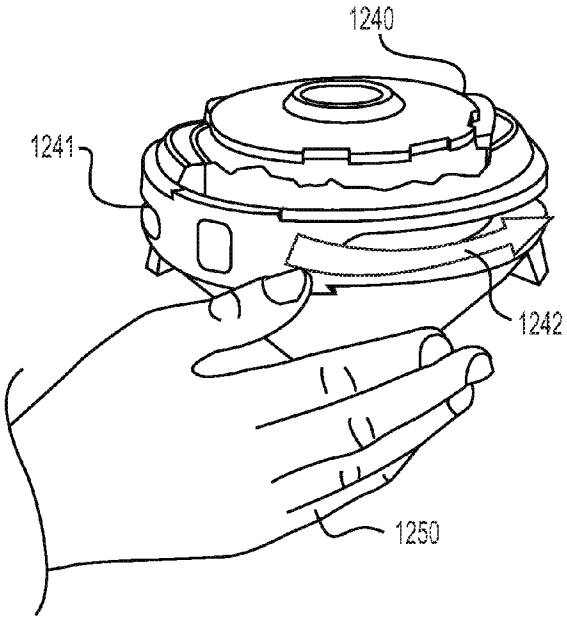
FIG. 12.9

MAGNETIC TOP SYSTEM AND METHOD

The application is a division of U.S. Publication No. 2010/0159798, published Jun. 24, 2010 (U.S. application Ser. No. 12/636,503, filed Dec. 11, 2009), which claims the benefit of U.S. Provisional Application No. 61/140,016, filed Dec. 22, 2008, both of which are herein incorporated by reference in their entirety.

BACKGROUND

1. Field of the Invention

The present invention relates generally to spinning top toys, and more particularly, to magnetically launched and controlled spinning top toys.

2. Background of the Invention

Spinning tops are well known in the field of toys and games. Although simple versions of tops can entertain children and adults, toy makers have recently introduced more complex tops that are launched by rack-and-pinion-type rip cords and that battle each other within an arena. Following this trend, there is a constant need for new and interesting spinning top toys and play patterns that appeal to consumers.

SUMMARY

Embodiments present a novel set of apparatus and play schemes involving the use of magnets to energize, launch, and control the movement of spinning tops. In one embodiment, a magnetic top system may comprise a top and top launcher, and a top controlling device operable to magnetically guide the top while it is spinning, without contacting the magnetic top. The top and top launcher may also be configured to magnetically couple to each other. In one implementation, a magnetic top system may comprise a magnetic top containing one or more magnets disposed in an upper portion of the top and a top launcher having a rotating member configured to magnetically engage the upper portion of the magnetic top. The rotating member may be, for example, a rotating metal disk, a rotating plastic disk with metal inserts, or a rotating disk having embedded magnets.

In an aspect, a top launcher may be configured as a portable joystick that may be grasped by a user's hand. The joystick may include a battery pack, a motor, a disk mechanically coupled to the motor, and a trigger configured to electrically couple the battery pack to the motor, such that engaging the trigger serves to start and stop a spinning motion in the disk. The disk may be a plastic disk with ferromagnetic inserts (e.g., metal inserts) or a disk made entirely out of ferromagnetic material (e.g., metal).

In another aspect, a top launcher may be configured to be worn on a user's hand and may include a spinner that contains a rotating member and may be configured to secure against the palm of the user's hand. The rotating member may be configured to magnetically couple to a top and may be, for example, a disk having metal and/or magnetic inserts. In an embodiment, a top launcher may include a power source and a switch configured to electrically couple the power source to a motor in the top launcher. The motor may be mechanically coupled to the rotating member in the top launcher, such that the motor drives the rotating member. The rotating member may comprise a disk having a magnet disposed in a central portion and a plurality of outer ferromagnetic or magnetic portions located around the centrally disposed magnet.

In another aspect, the upper facing surface of a magnetic top may be generally flat or slightly convex, such that a central magnet of a magnetic top may attach to a centrally disposed magnet in the rotating member of the top launcher. The magnetic top may also contain a plurality of outer magnets arranged around the central magnet and configured to magnetically couple to outer ferromagnetic or magnetic portions in the rotating member of the top launcher.

In another aspect, a top controlling device may be configured to be worn on a user's finger and may include a magnet portion configured to couple to the central magnet of the magnetic top. When brought into magnetic proximity of the magnetic top while the magnetic top is spinning, the magnet portion of the controlling device may guide the movement of the magnetic top over a surface without touching the magnetic top. In this manner, a user may control the movement of a magnetic top and may play with the top on any surface that enables the top to spin. Moreover, top controlling devices may allow multiple users to control their spinning tops on any flat surface to either contact or avoid each other.

Although embodiments may be suitable for any surface that enables the tops to spin, a further embodiment provides a defined play surface on which the magnetic top may be placed or onto which the magnetic top may be dropped. The play surface may be, for example, an arena that has containing walls and may include paths and stationary and moving obstacles that guide or restrict the motion of the magnetic top.

In another aspect, a magnetic launcher may be configured to pick up, spin, and launch the magnetic top. The magnetic launcher may have a rotating member that magnetically couples to a top having a magnet centrally disposed in its upper portion. The rotating member (e.g., rotating disk) may have a centrally disposed magnet. When the central magnet of the magnetic top is attached to a centrally disposed magnet of the rotating member, the magnetic top launcher may be configured to spin the magnetic top when the motor is powered. Preferably, the rotating member has outer magnetic portions that attach to respective outer magnetic portions of the magnetic top to provide torque action that is generated by rotation of the rotating member and is imparted to the magnetic top when the rotating member is spinning. The launcher may be configured such that a user can release the magnetic top from the spinning rotating member by a motion, such as a flick of the wrist or a tap or bump on the launcher. The rotating member may be further configured to pick up the magnetic top while the top is spinning when the centrally disposed magnet of the rotating member is placed near to the central magnet of the magnetic top. In addition, the rotating member of the magnetic top launcher may be brought into magnetic proximity of a spinning top to magnetically couple to, but not physically couple to, the spinning top. In this manner, the magnetic top launcher may re-energize the spinning top without physically picking up the top, to keep the top spinning for a longer duration.

In another aspect, a play surface may comprise a fluorescent or phosphorescent material and a top may include a light-emitting portion. The light-emitting portion may be disposed on a lower region of the top and may emit light of sufficient energy to cause nearby portions of the fluorescent or phosphorescent play surface to emit light. Accordingly, as the spinning top travels over the play surface, a fluorescent pattern may be produced in the play surface that corresponds to the path of the top. Accordingly, with a magnetic top, a user may magnetically guide the magnetic top using a magnetic controlling device to engage in a series of movements that are recorded as temporary glowing patterns in the play surface.

Another aspect provides a magnetic top toy kit comprising a magnetic top, a top launcher, and a magnetic controller. The magnetic top may comprise a top body and at least one magnet disposed in the top body. The top body may have a tip portion and a head portion opposite to the tip portion. The top may have a rotational axis extending from the head portion to the tip portion. The top launcher may include a top launcher body, a top launcher spinning member connected to the top launcher body, a spinning member drive for imparting rotation to the top launcher spinning member, and a releasable coupling for coupling the magnetic top to the top launcher spinning member. The top launcher spinning member may be rotatable relative to the top launcher body around a spinning axis. The spinning member drive may selectively impart rotation to the top launcher spinning member so as to cause the top launcher spinning member to spin relative to the top launcher body around the spinning axis. The releasable coupling may couple the magnetic top to the top launcher spinning member so that rotation of the top launcher spinning member may be imparted to the magnetic top so that the magnetic top spins about the magnetic top rotational axis, and may allow disengagement of the spinning magnetic top from the top launcher spinning member. The magnetic controller may include a magnet and a magnet holder that is attachable to a user's hand.

Another aspect provides a magnetic top system comprising a top and a top launcher. The top may comprise a top body and at least one magnet. The top body may have a tip portion and a head portion opposite to the tip portion. The top may have a rotational axis extending from the head portion to the tip portion. The at least one magnet may be disposed in the head portion of the top body. The top launcher may be magnetically coupled to the top, and may comprise a top launcher body and a top launcher spinning member connected to the top launcher body. The top launcher spinning member may spin relative to the top launcher body around a spinning axis. The top launcher spinning member may contain at least one magnetic portion that is magnetically coupled to the at least one magnet of the top. The rotational axis of the top and the spinning axis of the top launcher spinning member may be aligned. The top launcher spinning member may spin and thereby rotate the top by virtue of the magnetic coupling between the at least one magnet of the top and the at least one magnetic portion of the top launcher spinning member.

Another aspect provides a magnetic top assembled from a plurality of parts. The top may comprise a magnetic core part, a tip part, and a tip holder. The tip part may be held between the magnetic core part and the tip holder. The tip part may extend through an opening in the tip holder. The tip holder may engage the magnetic core part to hold the parts together in an assembly. The assembled top may have a tip portion and a head portion opposite to the tip portion, and may spin around a rotational axis extending from the head portion to the tip portion. The core magnetic part may provide at least one magnet disposed in the head portion of the assembled top.

Another aspect provides an alternative magnetic top assembled from a plurality of parts. In this aspect, the top may comprise a locking magnetic part, a core tip part, and a bumper part. The locking magnetic part may engage the core tip part to hold the bumper part between the locking magnetic part and the core tip part. The locking magnetic part may have a first face facing the bumper part and a second face opposite to the first face. The locking magnetic part may have at least one magnet disposed at the second face, and may have a switch disposed at the second face. The magnetic top may spin around a rotational axis. The switch may be centered at the rotational axis of the magnetic top. The switch may activate a feature of the core tip part.

Another aspect provides a method for launching and controlling a magnetic top. The method may include assembling a plurality of parts into a magnetic top having a head portion and a tip portion, such that at least one magnet is disposed at the head portion; magnetically attaching the magnetic top to a magnetic spinning member of a top launcher having at least one magnetic portion, by aligning the at least one magnet with the at least one magnetic portion; spinning the magnetic spinning member of the top launcher, thereby rotating the magnetically coupled magnetic top; and applying a force to the top launcher to release the rotating magnetic top from the magnetic spinning member onto a play surface.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

FIG. 2.1 is a schematic diagram of a side isometric view of an embodiment of a magnetic top;

FIG. 2.2 is a schematic diagram of a top isometric view of the magnetic top of FIG. 2.1;

FIG. 2.3 is a schematic diagram of a bottom isometric view of the magnetic top of FIG. 2.1;

FIG. 2.4 is a schematic diagram of an exploded bottom, side isometric view of the magnetic top of FIG. 2.1;

FIG. 2.5 is a schematic diagram of an exploded top, side isometric view of the magnetic top of FIG. 2.1;

FIG. 2.6 is a schematic diagram of an isometric view of another embodiment of a magnetic top;

FIG. 2.7 is a schematic diagram of an exploded top, side isometric view of the magnetic top of FIG. 2.6;

FIG. 2.8 is a schematic diagram of an exploded top, side isometric view of another embodiment of a magnetic top;

FIG. 2.9 is a schematic diagram of an exploded top, side isometric view of another embodiment of a magnetic top;

FIG. 2.10 is a schematic diagram of a cross-sectional view of the magnetic top of FIG. 2.9 in an assembled state;

FIG. 3.1 is a schematic diagram of a top isometric view of an embodiment of a top launcher;

FIG. 3.2 is a schematic diagram of a bottom isometric view of the top launcher of FIG. 3.1;

FIG. 3.3 is a schematic diagram of an exploded top, side view of the top launcher of FIG. 3.1;

FIG. 3.4 is a schematic diagram of an embodiment of a top launcher attached to a magnetic top and worn by a user;

FIG. 4.1 is a schematic diagram of a top isometric view of an embodiment of a top controlling device;

FIG. 4.2 is a schematic diagram of a bottom isometric view of the top controlling device of FIG. 4.1;

FIG. 4.3 is a schematic diagram of a side view of the top controlling device of FIG. 4.1;

FIG. 4.4 is a schematic diagram of an isometric view of another embodiment of a top controlling device;

FIG. 4.5 is a schematic diagram of an isometric view of an embodiment of a controller tip and magnet for the top controlling device of FIG. 4.4;

FIG. 5.1 is a schematic diagram of an embodiment of a magnetic top launcher and top controlling device, worn by a user;

FIG. 5.2 is a schematic diagram of a bottom view of the magnetic top launcher and top controlling device of FIG. 5.1;

FIG. 5.3 is a schematic diagram of a top view of the magnetic top launcher and top controlling device of FIG. 5.1;

FIG. 7.1 is a schematic diagram of an embodiment of a play surface for a magnetic top toy system;

FIG. 7.2 is a schematic diagram of another embodiment of a play surface for a magnetic top system;

FIGS. 7.3-7.5 are schematic diagrams of embodiments of spin members for the play surface of FIG. 7.2;

FIG. 9.1 is a schematic diagram of a side view of another embodiment of a top launcher, with a magnetic top attached;

FIG. 9.2 is a schematic diagram of a side cross-sectional view of the top launcher of FIG. 9.1;

FIG. 9.3 is a schematic diagram of a top isometric view of the top launcher of FIG. 9.1, with a removable medallion cover piece;

FIG. 9.4 is a schematic diagram of a side view of another embodiment of a top launcher;

FIG. 9.5 is a schematic diagram of a side cross-sectional view of the top launcher of FIG. 9.4;

FIG. 9.6 is a schematic diagram of an embodiment of a magnetic disk having a central metal insert and three outer metal inserts, coupling to an embodiment of a magnetic top having a central magnet and three outer magnets;

FIG. 9.7 is a schematic diagram of an embodiment of a magnetic disk having a central metal insert and three outer metal inserts, coupling to an embodiment of a magnetic top having a central magnet;

FIG. 10.1 is a schematic diagram of an isometric view of an embodiment of a magnetic top launcher having an adjustable strap;

FIG. 10.2 is a schematic diagram of a exploded view of the adjustable strap of FIG. 10.1;

FIG. 11 is a schematic diagram of a side isometric view of an embodiment of a rip cord top launcher attached to a magnetic top;

FIG. 12.1 is a schematic diagram of another embodiment of a magnetic top and a top controller, which may provide an additional feature during spinning of the top;

FIGS. 12.2-12.4 are schematic diagrams illustrating an embodiment of a magnetic top and top controller providing movement of striking members during spinning of the top;

FIGS. 12.5-12.6 are schematic diagrams illustrating an embodiment of a magnetic top and top controller providing movement of shield members during spinning of the top;

FIGS. 12.7-12.8 are schematic diagrams illustrating an embodiment of a magnetic top and top controller providing a changeable tip during spinning of the top; and FIGS. 12.9-12.10 are schematic diagrams illustrating an embodiment of a magnetic top and top controller providing movement of a rotating shield member during spinning of the top.

DETAILED DESCRIPTION

Figure 1:
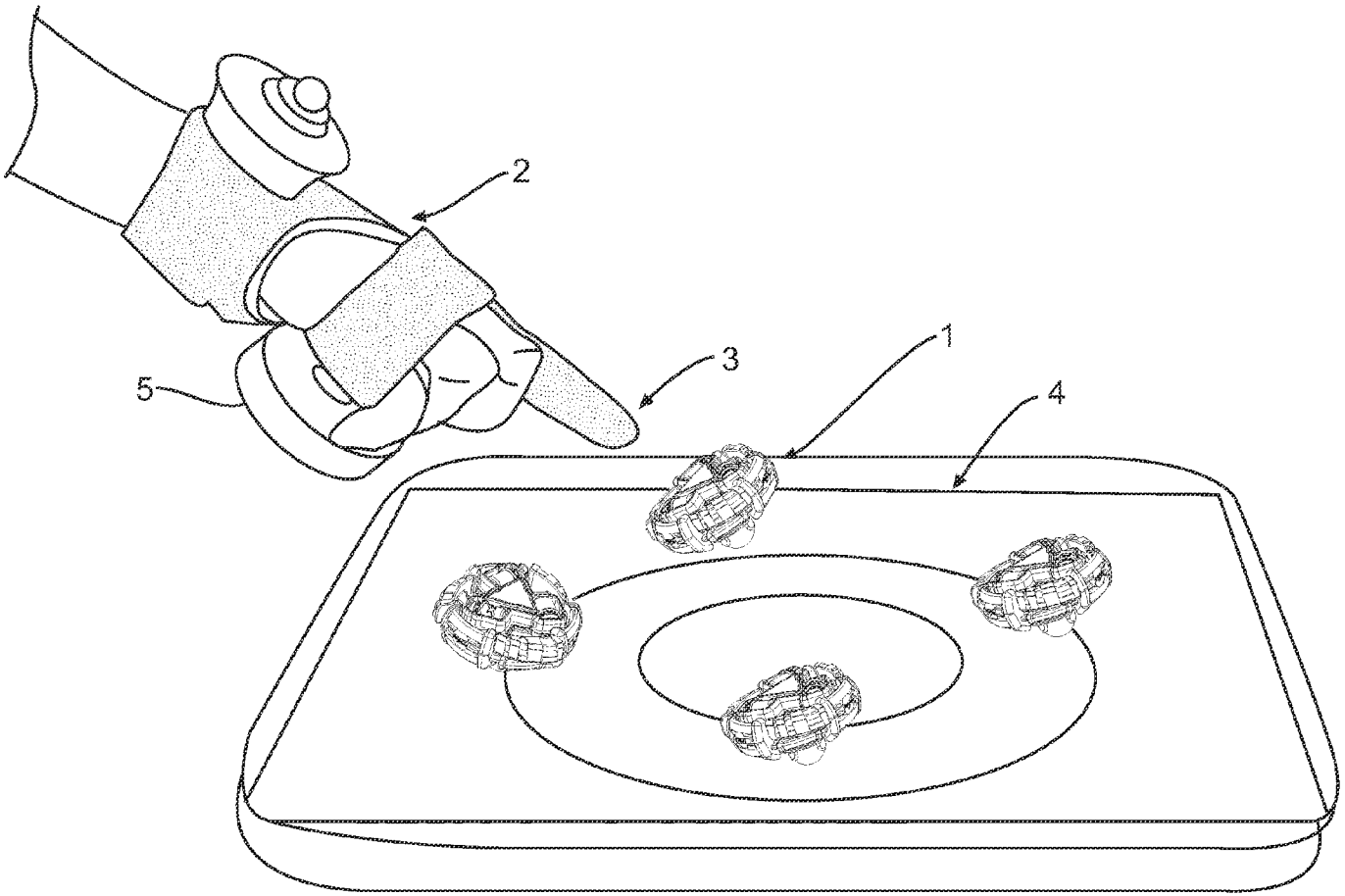
FIG. 1 is a schematic diagram that depicts an embodiment of a magnetic top toy system.

FIG. 1 depicts an embodiment of a magnetic top toy system. In one embodiment, a magnetic toy top system, or kit, may include a magnetic top, a top launcher, and a magnetic controller. As shown in FIG. 1, magnetic top 1 may be a top configured to spin along a rotation axis when its tip engages a surface, such as play surface 4. Embodiments of the magnetic top are described in more detail with respect to the figures to follow. Magnetic top 1 may include a magnet disposed on an upper portion of the top that may be conveniently engaged by a separate magnet or a ferromagnetic surface brought into proximity of the upper portion of magnetic top 1. Accordingly, in embodiments, a separate magnet or ferromagnetic surface may be used to pick up, hold, spin, guide, and otherwise manipulate magnetic top 1.

FIG. 1 also depicts a top launcher 2, which may be configured as a glove to be worn on a user's hand. Top launcher 2 may include a top launcher body, a top launcher spinning member, a spinning member drive, and a releasable coupling. The top launcher spinning member may be connected to the top launcher body and may rotate relative to the body around a spinning axis. The spinning member drive may selectively impart rotation to the top launcher spinning member so as to cause the top launcher spinning member to spin relative to the top launcher body around the spinning axis. The releasable coupling may couple the magnetic top to the top launcher spinning member so that rotation of the top launcher spinning member may be imparted to the magnetic top so that the magnetic top spins about the magnetic top rotational axis. The releasable coupling may allow disengagement of the spinning magnetic top from the top launcher spinning member. In one aspect, the releasable coupling may be a magnetic coupling. In another aspect, the releasable coupling may be a quick-release mechanical coupling.

As shown in the embodiment of FIG. 1, top launcher 2 may include a rotating magnetic disk portion 5, which may be configured to fit under a user's palm, as shown. Top launcher 2 may include a power source, such as a battery (not shown) that may be used to power a motor that rotates magnetic disk 5 in a spinning motion. The term "magnetic disk," as used herein, refers to a generally circular shaped feature that may include at least one region of magnetic material, and generally may include a portion of non-magnetic material, such as plastic, that encases or holds the magnetic portion(s). The terms "magnetic material," or "magnetic portion," as used herein, generally refer to a ferromagnetic material that may be a magnet, or may be a magnetizable material that is strongly attracted to a magnet, but does not act as a magnet itself. In accordance with an embodiment of the present invention, magnetic disk portion 5 may include a centrally disposed magnet or metal insert (not shown) that may be configured to attach to a magnet in magnetic top 1.

Thus, magnetic disk 5 may pick up and attach to magnetic top 1 and cause magnetic top 1 to spin while attached to magnetic disk 5. While spinning and attached to top launcher 2, magnetic top 1 may be launched onto play surface 4 by a motion, such as a flick of the wrist of the user wearing top launcher 2. Alternatively, a user may tap, bump, or slap the top of the hand holding the top launcher 2 with the user's opposite hand, to release the magnetic top 1 from the top launcher 2. Magnetic top 1 may subsequently move in a manner characteristic of tops across play surface 4. For example, when magnetic top 1 is launched onto a surface, it may spin on its axis, undergo a precession of its axis as well as move along the surface, that is, undergo a translational motion across the play surface.

In an embodiment as shown in FIG. 1, a top controlling device 3 may also be provided, which may be worn on a user's finger, as shown. In one embodiment, the top controlling device 3 and magnetic disk portion 5 may be integrated into a glove worn by the user. Top controlling device 3 may include a magnetic portion that may strongly magnetically couple to, or repel, the magnet in magnetic top 1. When top controlling device 3 is brought into magnetic proximity of magnetic top 1, a user may guide the motion of the spinning magnetic top 1 by moving the user's finger attached to top controlling device 3. The term "magnetic proximity," as used herein, denotes a physical distance between a magnet in a top controlling device and a magnet in a magnetic top within which distance a substantial magnetic attraction or repulsion between the respective magnets exists, as evidenced, for example, when movement of the magnetic controlling device causes a movement in the magnetic top. In some embodiments, top controlling device 3 may be arranged to either magnetically attract or magnetically repel magnetic top 1, such that the motion of magnetic top 1 may be changed by the motion of magnetic controlling device 3. For example, magnetic controlling device 3 may cause magnetic top 1 to change its path (change its translational motion). Controlling device 3 may also change the precession of magnetic top 1, or cause a precession in magnetic top 1, and may also change the rotation speed of the spinning magnetic top 1.

As discussed in more detail below, play surface 4 may be arranged with a variety of features designed to enhance the play experience when magnetic top 1 is spinning on the play surface.

In an embodiment, top launcher 2 may also be configured to pick up magnetic top 1, while magnetic top 1 is spinning. Accordingly, a user may pick up magnetic top 1 to re-energize the top and increase its spinning speed after the speed of magnetic top 1 starts to slow down, or to simply rapidly move magnetic top 1 from one place to another. In addition, a top launcher, with its magnetic disk rotating, may be brought into magnetic proximity of a top while the top is spinning, to re-energize the top without physically coupling to the spinning top. For example, a rotating member of a top launcher may magnetically couple to a spinning top to increase the rotational speed of the top, without physically touching the top.

In one example of a play pattern, a plurality of players may each operate a top launcher, magnetic top, and top controlling device on a common field of play, such as play surface 4. Accordingly, each user may guide the user's top around or through obstacles, around or into an opponent's top, and may pick up the top as desired. Alternatively, instead of play surface 4, the common field of play may be any surface that enables the tops to spin (e.g., a table or the floor). Indeed, because of the unique control aspects provided by the top controlling device and top launcher, it may be unnecessary to provide specialized play surfaces such as confined play arenas (e.g., a bowl-shaped arena that urges spinning tops by gravity to the central lowermost point of the arena to promote contact between uncontrolled tops). The unique control aspects may enable users to control spinning tops on any surface, including flat surfaces or even convex surfaces, to avoid or contact each other as desired.

In some embodiments, magnetic tops may be provided with generally flat upper surfaces that allow the tops to conveniently attach to the lower surface of a top launcher, which may be provided with one or more magnetic portions, such as magnets or metal inserts. The generally flat upper surface of the magnetic top may also facilitate providing more than one magnetic portion in the magnetic top, each of which may attach to a corresponding magnetic portion in the magnetic disk of the top launcher.

In some embodiments, both the top launcher and magnetic top may include centrally disposed magnetic portions located along their respective spinning axes. The centrally disposed magnetic portion of the magnetic top is preferably a magnet that has at least one surface located on the upper surface of the magnetic top. The centrally disposed magnetic portion of the rotating member of the top launcher likewise preferably has a surface located on the outer surface of the rotating member that may contact and attach to the centrally disposed magnetic portion of the magnetic top. The top launcher may have, for example, a ferromagnetic rotating member (e.g., a metal disk or a plastic disk with metal inserts) that magnetically couples to the magnetic top.

To facilitate understanding, in the discussion to follow, the centrally disposed magnetic portion of the magnetic top is also referred to as the "central magnet," although in embodiments, the centrally disposed magnetic portion of the magnetic top can be a ferromagnetic material that is not a permanent magnet.

In addition to the central magnet, in accordance with embodiments, the magnetic top may be provided with a plurality of outer magnetic portions that each may have surfaces located on the upper surface of the magnetic top. The outer magnetic portions may be arranged to surround the central magnet and may be equally spaced around the central magnet, for example, in a pattern of three magnetic portions, or alternatively, in a pattern of four magnetic portions, or any convenient number of magnetic portions.

In a top launcher, in addition to the centrally disposed magnetic portion (also termed "central magnetic portion" herein) of the rotating member (e.g., magnetic disk), a plurality of outer magnetic portions may also be provided, which surround the central magnetic portion. Each of these magnetic portions may be configured to engage a corresponding magnetic portion in the magnetic top. For example, the pattern of the central magnet and surrounding magnetic portions of the magnetic top may be arranged to match a corresponding pattern in the magnetic disk of the top launcher. Thus, the number of outer magnetic portions in the magnetic disk of the top launcher may match that of the magnetic top, and the relative spacing of the outer portions of the magnetic disk, both with respect to each other and with respect to the central magnetic portion, may match the corresponding spacing of the outer portions of the magnetic top.

Accordingly, in these embodiments, the magnetic top and magnetic disk may be configured to attach to each other at a plurality of points along their respective surfaces. When the top launcher magnetic disk is energized to spin, the attached magnetic top may be held not only in its center, but at a plurality of outer regions, thus providing a greater torque for spinning the magnetic top. It will be readily appreciated that the torque acting on the magnetic top increases in proportion to the radial distance of the magnetic portions of the magnetic disk and magnetic top from their respective central magnetic portions.

In an embodiment depicted in FIGS. 2.1-2.5, a magnetic top 200 may include a series of parts 202-212 that may be assembled as shown more particularly in FIGS. 2.4 and 2.5. Cap part 212 may be configured to couple to tri-magnet part 210 by engaging apertures 211 of tri-magnet part 210 using posts 213 of cap part 212. Cap part 212 may be a tradable, collectable face plate, which may or may not include a magnet. Tri-magnet part 210 may be configured as a set of three magnets (shown as horizontally disposed cylindrical magnets) spaced equally along a triangular central portion, which may be configured to fit into a recess 209 of magnet holder 208. Post 207 of magnet holder 208 may be provided with tabs configured to interlock with ring 203 of tip 202. When fully assembled, magnet holder 208 thus may lock tip 202 and bumpers 204, 206 together as a single top. Upper bumper 206 and lower bumper 204 may be configured to assemble together as depicted more particularly in FIGS. 2.1 and 2.2. In the embodiment depicted generally in FIGS. 2.1-2.5, each bumper 204, 206 may contain three respective outer portions 214, 216 that may be mutually spaced apart along a circumference of a central portion. When assembled, the outer portions 214, 216 may alternate around the circumference of magnetic top 200. In other embodiments, bumpers can include two, four, or more outer portions.

The outer portions 214, 216 may be configured to extend farthest from the center of magnetic top 200 and may thus be configured to engage another object, such as another magnetic top. In some embodiments, magnetic top 200 may be configured in a plurality of structures by substituting other parts for one or more of parts 202, 204, 206, and 208, for example. The substitute parts may be designed to assemble together with any other existing parts. For example, a substitute upper bumper may be provided that replaces bumper 206 and may be configured to assemble together with lower bumper 204 and magnet holder 208. The upper bumper may differ in color and shape of outer portions 216, for example. Similarly, substitutes may be provided for lower bumper 204, tip 202, and magnet holder 208. Thus, for each corresponding part 202-212 of magnetic top 200, a user may collect and trade a plurality of different pieces, enabling the user to custom-build a large variety of different magnetic tops by mixing and matching and interchanging the various parts.

In the embodiment depicted in FIGS. 2.1-2.5, tip 202 may comprise a metal sphere enclosed in a housing, such as a socket. However, in other embodiments, the tip may have a different shape, such as cylindrical, conical, pyramidal, and oblong. An example of a differently shaped tip is shown in FIGS. 2.6 and 2.7, discussed below.

In other embodiments, two or more of the upper parts 208-212 of magnetic top 200 may be replaced with a single unitary piece that contains a central magnet and outer magnetic portions. An example of this configuration is shown in FIGS. 2.6 and 2.7, discussed below. Preferably, the central magnet and outer magnetic portions have their magnetic axes pointing parallel to the spinning axis of the magnetic top (i.e., generally vertical when the top is spinning upright on a horizontal surface), with their respective magnetic poles configured to be attracted to the corresponding magnetic portions of a magnetic top launcher. In one example, the magnetic north pole or magnetic south pole of the central magnet may face upwardly substantially orthogonal to the upper surface of the magnetic top, and the outer magnetic portions may also be magnets configured similarly to the central magnet.

In one embodiment, the central magnetic portions and outer magnetic portions of the magnetic disk of the top launcher may each be magnets arranged with their respective outwardly facing magnetic poles configured to be opposite to that of the outwardly facing magnetic poles of their respective counterparts in the magnetic top. Thus, in the magnetic top, all the north poles may be facing up extending outwardly from the upper surface, while all the magnets in the top launcher magnetic disk may have their south poles facing outwardly. In another embodiment, all the magnetic portions of the magnetic top may be magnets, while all the magnetic portions of the magnetic disk of the top launcher may be ferromagnetic materials that are not permanent magnets, such as metal inserts.

FIGS. 2.6 and 2.7 illustrate a magnetic top 250 according to another embodiment. As shown, top 250 may include a cap part 252, a magnet part 260, a first bumper 256, a second bumper 254, a tip 252.1, and a tip holder 252.2. Magnet portion 260 may include projections 261 that fit through slots of bumpers 254, 256 and lock into corresponding keyed channels of tip holder 252.2, to keep magnet part 260, bumpers 254, 256, tip 252.1, and tip holder 252.2 held together in an assembled configuration. Flexible projections 253 of cap part 252 may fit into corresponding openings of magnet portion 260 and snap over tabs within those openings (not shown) to secure cap part 252 to magnet portion 260. FIG. 2.6 shows an embodiment of the assembled top 250. Magnet portion 260 may include four encased magnets as shown, one in a central position 262, and three in outer positions 263 spaced equally around the central magnet. As shown in the assembled configuration in FIG. 2.6, the encased magnets may project slightly above the remainder of the top 250 to facilitate better magnetic coupling to a magnetic launcher. Tip 252.1 may have a partially spherical shape as shown.

FIG. 2.8 illustrates a magnetic top 270 according to another embodiment, which may use fewer parts than embodiments described above and may provide an alternative locking arrangement. As shown, top 270 may include a bumper 272, a core magnet part 274, a spin performance ring 276, a tip 272.1, and a locking tip holder 272.2. Bumper 272 may include a central opening 273 configured to receive a projecting central magnetic portion 275 of magnet part 274 and outer openings 277 configured to receive hooked projecting members 279 of magnet part 274, to lock bumper 272 to magnet part 274. Ring 276 may be configured to receive and/or engage with magnet part 274 and/or cap part 272, and may also define an opening 280 through which locking tip holder 272.2 may pass. An upper portion of tip 272.1 may also pass through opening 280 and engage magnet part 274. Locking tip holder 272.2 may include a recess 281 configured to receive and hold tip 272.1, and a lower opening (not shown) through which the tip 272.1 extends in order to contact a playing surface. Locking tip holder 272.2 may have locking members 282 that engage magnet part 274 and may thereby hold together locking tip holder 272.2, tip 272.1, ring 276, and magnet part 274. Locking tip holder 272.2 may also have flanges 285 that press against collars 286 of ring 276 to keep ring 276 in place. In one embodiment, the parts of top 270 are stacked as represented by the arrow 283, and the locking tip holder 272.2 is then turned as represented by the arrow 284, to lock tip holder 272.2 to magnet part 274.

Although FIG. 2.8 shows exemplary shapes and sizes for the parts of magnetic top 270, the parts may be formed in other shapes and sizes to accommodate desired spinning and battling characteristics and play patterns. For example, although shown with a rounded tip in the embodiment of FIG. 2.8, tip 272.1 may also have other shaped tips, such as a flat surface, a cylinder, a pointed structure, a dome, or a metal sphere. Similarly, to provide desired spinning and battling characteristics and play patterns, bumper 272 may be configured in other shapes, sizes, and materials, including plastic and metal, for example. Ring 276 may also be formed in other shapes and outer contours, which may affect the spin characteristics and performance of a top.

FIGS. 2.9-2.10 illustrate a magnetic top 290 according to another embodiment, which may use fewer parts and an alternative locking arrangement, and which may also enable the activation of a feature (e.g., moving parts) while the top is spinning. As shown in FIGS. 2.9-2.10, magnetic top 290 may include a locking magnet part 291, a bumper 292, and a core tip 293. Locking magnet part 291 may include one or more magnets in its upper surface for magnetically coupling to a magnetic disk of a top launcher. Locking magnet part 291 may also include a switch 294 configured to activate a feature in the core tip 293. Bumper 292 may be disposed between the locking magnet part 291 and the core tip 293, and may extend laterally outward beyond the other parts to provide outer surfaces to contact other objects, such as walls of a play arena or other spinning tops. Locking magnet part 291 may include a threaded portion 295 configured to engage a correspondingly threaded recess 296 in core tip 293, as shown in the cross-sectional view of FIG. 2.10. In this manner, the locking magnet part 291 may attach to the core tip 293 with the bumper 292 in between, to secure the assembly of the parts.

The locking magnet part 291 and the core tip 293 may include cooperating switches that activate a feature in the core tip 293. For example, as shown in the embodiment of FIG. 2.10, locking magnet part 291 may include a button post 297 mounted on a spring within the center axis of the part 291, which when pushed, presses a button 298 in the core tip 293 and activates a feature within core tip 293. The core tip 293 may include mechanical and/or electronic components that provide a feature, such as mechanically actuated moving parts, electronically actuated moving parts, or electronic sounds and lights. Exemplary features are described in more detail below. To magnetically couple to a top launcher, all or a portion of button post 297 may be a magnet. In this manner, button post 297 may serve as means both for magnetically coupling to a top launcher and for activating a feature in the core tip 293.

FIGS. 3.1-3.4 depict various views of another exemplary top launcher 300. According to this embodiment, top launcher 300 may include a magnetic disk 302, case 304, motor 306, handrest 308, switch 310, strap 312, battery case 314, and batteries 316. Top launcher 300 may be configured such that a user may insert a hand 349 between handrest 308 and strap 312, as depicted in FIG. 3.4. When a user presses switch 310, motor 306 may be turned either on or off by electrically coupling or decoupling batteries 316 to motor 310. Motor 310 may be configured to spin along its axis and may be mechanically coupled to magnetic disk 302, thereby causing magnetic disk 302 to spin when motor 310 is turned on. As shown in FIG. 3.4, top launcher 300 may therefore spin a magnetic top 350 magnetically coupled to the top launcher 300. A user may release the top 350 by a flick of the wrist or by tapping, bumping, or slapping the top of the hand holding the top launcher 300 with the user's other hand.

FIGS. 5.1-5.3 depict another exemplary top launcher and controller system 500. In this embodiment, system 500 may include battery pack 506 configured to be worn on a user's wrist or arm, and magnetic disk 502 configured to be worn under the user's palm and to be attached to the user's hand using strap 504. System 500 may also include an activation switch 507 that turns the magnetic disk 502 on and off. As depicted in FIG. 5.2, magnetic disk 502 may include a central magnetic portion 503 surrounded by three equally spaced magnetic portions 505 (e.g., metal inserts) located at a radial distance about several centimeters from the central magnetic portion.

FIGS. 9.1-9.3 depict various views of another exemplary top launcher 900. In this embodiment, top launcher 900 (also referred to as a joystick) may include head 902 that contains batteries 910 and grip portion 904 that includes a motor 908 inside. Motor 908 may also include an integrated or separately attached gear box. A magnetic disk 906, which may be similar to any magnetic disks described hereinabove, for example, may be disposed in the base portion 905 of joystick 900 and connected to motor 908 through shaft 907. A switch 912 may be provided at an upper region of grip portion 904 allowing a user to conveniently grasp joystick 900 while being able to turn motor 908 on and off by coupling/decoupling the motor to batteries 910. Thus, the user may conveniently pick up joystick 900, pick up a magnetic top 200 using joystick 900, and conveniently tilt joystick 900 so that magnetic top 200 may be launched at any desired angle, when the user flicks the wrist of her hand holding the launcher, for example. A user may also launch the top 200 by bumping the launcher 900 with the user's free hand or by tapping on the top of the launcher 900 with the user's free hand.

As shown in FIG. 9.3, top launcher 900 may also include a removable cover piece 913 and removable medallion 914. Cover piece 913 may provide a larger surface on which a user may tap or bump the launcher 900 to release a top. Medallion 914 may be a decorative and tradable piece. Cover piece 913 and medallion 914 may be attached and removed as desired, as represented by the arrows 915. Cover piece 913 may attach to top launcher 900 and medallion 914, by snap fittings or magnets, for example.

In another embodiment, FIGS. 9.4 and 9.5 illustrate another exemplary top launcher 980, similar to the launcher 900 of FIGS. 9.1-9.3. As shown, top launcher 980 may include a head 982 that contains batteries 990 and a grip portion 984 that contains a motor 988 and gear box 989. A magnetic disk 986 may be disposed in the base portion 985 of top launcher 980 and may be connected to gear box 989 and motor 988 through shaft 987. A switch 992 may be provided at an upper region of grip portion 984 allowing a user to conveniently grasp launcher 980 while turning motor 988 on and off by coupling/decoupling the motor 988 to batteries 990. Head 982 may provide a long and wide flat upper surface, convenient for tapping, bumping, or slapping by a user to release a spinning top coupled to the magnetic disk 986. Head 982 may also provide a recess or coupling for attaching a decorative and tradable medallion 994 to the launcher 980. Launcher 980 may also include a finger guard 995 spaced apart from grip portion 984 and extending from the head 982 to the base portion 985. Finger guard 995 may prevent a user's finger from contacting other objects while the user grasps and uses the launcher 980.

As shown in the cross-sectional view of FIG. 9.5, magnetic disk 986 may be recessed within the base portion 985 such that only the face of magnetic disk 986 may be exposed for coupling to a magnetic top. As shown, the edges of magnetic disk may be contained inside the base portion 985 and not exposed. This recessed configuration may prevent the edges of spinning magnetic disk 986 from inadvertently contacting other objects. In addition, the recessed configuration may facilitate better coupling with a magnetic top, by capturing the top within the recess 991 of the base portion 985 and centering the top with respect to the magnetic disk 986.

In an embodiment, a magnetic disk, such as the magnetic disks 906, 986 of launchers 900, 980, respectively, may be compatible with magnetic tops having different numbers and arrangements of magnets in their upper surfaces. For example, a magnetic disk may have a central magnetic portion surrounded by a plurality of magnetic portions spaced equally around the central magnetic portion and located at a radial distance from the central magnetic portion. In this manner, the magnetic disk may couple with magnetic tops having magnets at positions corresponding to any one or more of the magnetic portions of the disk.

As one embodiment, FIGS. 9.6 and 9.7 illustrate a magnetic disk 920 having a central metal insert 922 and three outer metal inserts 924 spaced equally around the central metal insert 922. Inserts 922, 924 may be steel inserts 6 mm in diameter and 6.5 mm thick, for example. With the four inserts 922, 924 arranged as shown in FIGS. 9.6 and 9.7, magnetic disk 920 may couple with a magnetic top having magnets at positions corresponding to any one or more of the inserts 922, 924. FIG. 9.6 illustrates a top 931 having magnets 930 positioned at all four positions of inserts 922, 924, coupling with the magnetic disk 920 as represented by the lines 932. In another embodiment, FIG. 9.7 illustrates a top 933 having a single central magnet 934 positioned to couple with the central metal insert 922, as represented by the line 936.

In addition to magnetic couplings, magnetic disk 920 may also include provisions to mechanically couple to a magnetic top. For example, as shown in FIGS. 9.6 and 9.7, magnetic disk 920 may define a recess 926 around central metal insert 922, and a flange 928 within which the central metal insert 922 may be held. The projecting flange 928 may fit inside a socket on the magnetic top, such as the sockets 940, 941 on tops 931, 933, respectively. At the same time, a socket on the upper surface of a magnetic top may fit inside a correspondingly shaped recess defined in a magnetic disk. For example, as shown in FIGS. 9.6 and 9.7, sockets 940, 941 may fit inside recess 926 of magnetic disk 920. These mechanical couplings may provide further stability and coupling forces between a magnetic disk and a magnetic top, and may conveniently center a magnetic top on a magnetic disk. The mechanical couplings may be especially useful to couple a magnetic disk to a spinning magnetic top, which may be moving transversely across a play surface and more difficult to align with a magnetic disk.

Referring again to FIGS. 5.1-5.3, system 500 may also include a top controlling device 508 that may be configured as a ring to be worn on the user's finger. Top controlling device 508 may contain a magnet that may guide a spinning magnetic top when brought into magnetic proximity of the magnetic top, for example, about one to several centimeters away from a magnet in the spinning top, as depicted generally in FIG. 6.

Figure 6:
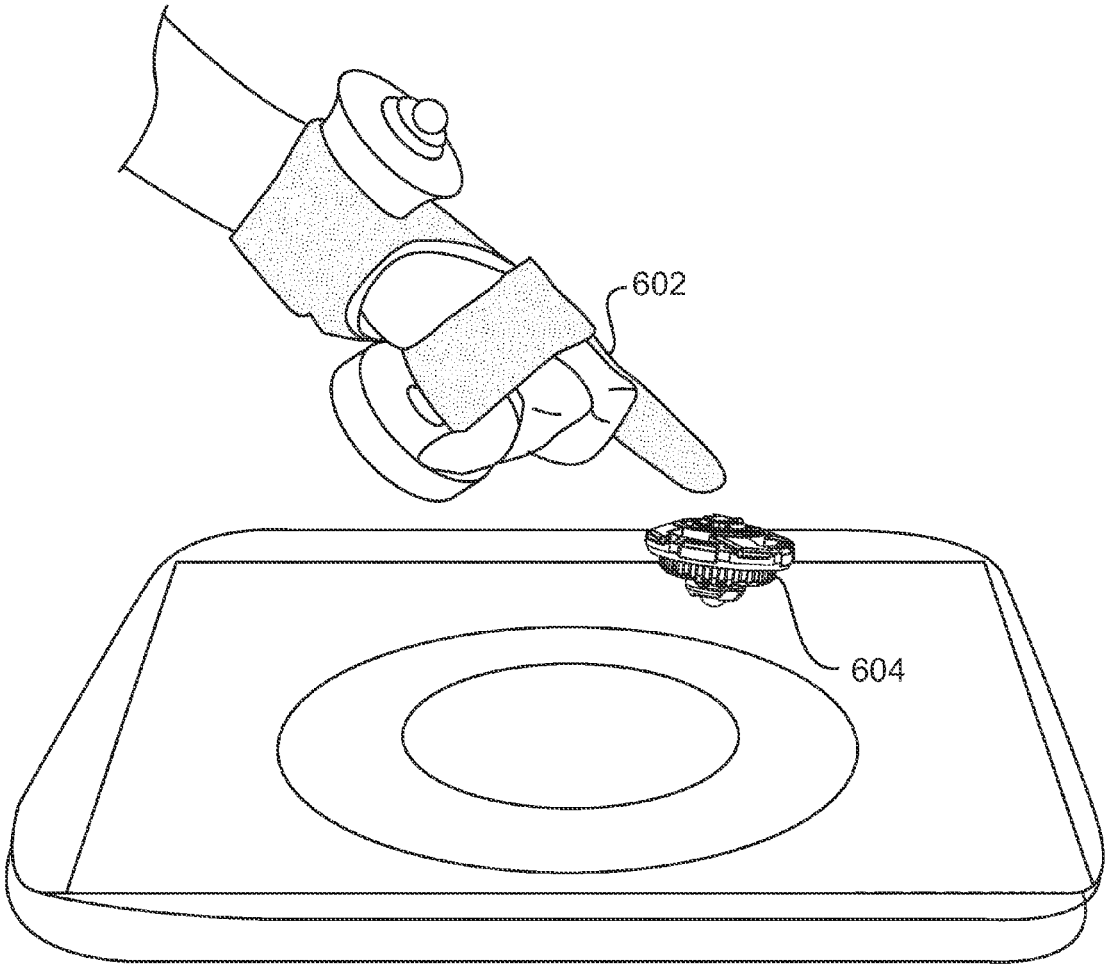
FIG. 6 is a schematic diagram of an embodiment of a magnetic top launcher and top controlling device controlling a spinning magnetic top.

FIG. 6 illustrates an alternative implementation of a top controlling device 602, which in this case includes a cover. As depicted, the top controlling device 602 may guide a magnetic top 604 without touching the magnetic top due to a strong attraction or repulsion between magnets located in the top controlling device 602 and magnets located in magnetic top 604. Control of the movement of magnetic top 604 may occur in the following manner. A user may bring top controlling device 602 within a few centimeters or so of magnetic top 604 while the magnetic top is spinning, wherein movement of top controlling device 602 is observed to cause a movement in magnetic top 604. The user may move top controlling device 602 above magnetic top 604 at a relatively constant vertical distance above magnetic top 604, wherein movement of the magnetic top 604 mimics movement of the top controlling device 602. The top controlling device 602 need not be directly above magnetic top 604, as long as a mutual magnetic attraction or repulsion exists. Thus, during "engagement," when top controlling device 602 is in magnetic proximity to magnetic top 604, the user may move top controlling device 602 at a relatively constant height over a play surface on which magnetic top 604 is spinning. This movement allows magnetic top 604 to "follow" controlling device 602 in the case of magnetic attraction or to "lead" top controlling device 602 in the case of magnetic repulsion where magnetic top 604 tends to move away from top controlling device 602. Top controlling device 602 may also be used to influence the precession of magnetic top 604 by moving top controlling device above magnetic top 604 as it wobbles in a manner that changes the degree of wobble. To break off the "engagement," the user may lift top controlling device 602 in a vertical direction so that the magnets in magnetic top 604 and top controlling device 602 no longer exert a substantial magnetic interaction between themselves.

FIGS. 4.1-4.3 depict another embodiment of a top controlling device (or, "top controller"). In this embodiment, top controller 400 may be configured to be worn on two adjacent fingers. Top controller 400 may include a base 401, a fingertip cover 403, a dividing wall 402 connected substantially perpendicular to base 401, and a strap 404 extending around the base 401 and dividing wall 402. A magnet 406 may be disposed in or on the base 401 or fingertip cover 403. A user's two adjacent fingers may rest on opposite sides of dividing wall 402 after insertion under strap 404. Magnet 406 may be configured so that it faces at an angle with respect to the long axis of fingers inserted into top controller 400. Accordingly, the strong lines of a magnetic field extending from magnet 406 may form an angle with respect to horizontal when the user's hand is horizontally extended over a surface. This configuration may aid in guiding a magnetic top by providing a magnetic field that engages a magnet in a magnetic top at an angle.

FIGS. 4.4-4.5 illustrate another embodiment of a top controller 410, which may be adjusted to accommodate differently sized fingers and to accommodate either a left or right hand. As shown, top controller 410 may include a handle 414, a stem 416 connected to the handle 414, a fingertip cover 418 attached to an end of the stem 416, and a magnetic portion 420 disposed at a distal end of the cover 418. Handle 414 may have a base portion 413 that defines a slot 412 that receives stem 416, and a grip portion 415 offset from the base portion 413 by a lateral portion 417. The interior of slot 412 may include a resilient projection (not shown) that is configured to deflect and pass over the solid portions of stem 416 along an array of openings 426, and then to resume its original position to engage one of openings 426. A user may therefore pull or push stem 416 to cause the resilient projection to deform and click into place within an opening that positions the fingertip cover 418 a desired distance away from handle 414.

A user may wear the top controller 410 by placing the tip of the user's forefinger inside fingertip cover 418 and grasping the handle 414 with one or more of the user's remaining fingers. Stem 416 may be extended as necessary to position the fingertip cover 418 over the end of the user's forefinger. Stem 416 may also be completely removable from handle 414 and insertable in either end of slot 412, so that the top controller 410 may be configured for either a left hand or a right hand. FIG. 4.3 illustrates top controller 410 configured for a right hand.

Magnetic portion 420 may encase a magnet 428 as shown in FIG. 4.5. Magnet 428 may be a cylindrical magnet approximately 10 mm in diameter and 3 mm in thickness, and may be configured to either attract or repel magnets of a magnetic top. In the case in which magnet 428 is configured to attract a top, magnetic portion 420 may be shaped to facilitate desirable contact and centering of a top. For example, as shown in FIG. 4.4, magnetic portion 420 may be conically shaped.

Top controller 410 may also include an integrated or separately attached actuator (not shown in FIG. 4.4) that may be used to activate a switch on a spinning magnetic top, which activates features of the spinning top, discussed below.

FIG. 7.1 depicts an exemplary play surface 700 for a magnetic top toy system. In this embodiment, the play surface 700 may be configured as an arena in which a plurality of tops can battle each other. In an embodiment, play surface 700 may be a shaped transparent plastic surface, that may be, for example, a 16"×16" square that includes a graphic beneath the surface that guides the play. The activated tops may be released onto surface 700, for example, in drop zones 702 defined on play surface 700, and then guided around the surface to hit each other, or to avoid obstacles, to make goals, and perform other actions. Play surface 700 may have walls 704 to contain the tops within the surface 700.

FIG. 7.2 illustrates another embodiment of a play surface 710 for a magnetic top toy system. In this aspect, surface 710 may include a spinning member 712 configured to contact the spinning magnetic tops and affect their movement. Spinning member 712 may be detachably coupled to a motor operated spinning base (not shown) in the bottom surface of the play surface 710. A control switch 714 coupled to the motor may activate and deactivate the motor to turn the spinning member 712 on and off. Play surface 710 may also include chutes 716 for introducing spinning magnetic tops into the battle area 720 inside the walls of the play surface 710. Chutes 716 may also serve as exits during play. For example, in one play pattern, a spinning top that is ejected first out of a chute 716, either by contacting spinning member 712, contacting an opposing magnetic top, or otherwise losing control, may be deemed to have lost a battle.

Play surface 710 may also include storage compartments 718 for storing individual magnetic tops while they are not in use.

In embodiments, spinning member 712 may be interchanged with other spinning members, as shown in FIGS. 7.3-7.5. The shape and contours of each spinning member may affect the spinning magnetic tops in different ways. For example, irregular or rough edges or surfaces of a spinning member, such as the spinning member 734 of FIG. 7.5, may contact spinning tops and cause the tops to move erratically or to stop spinning. In addition to particular shapes and contours, each spinning member may be configured with control features that control the direction in which the motor spins. For example, spinning member 730 of FIG. 7.3 may be configured to control the motor such that the motor rotates in a direction opposite to that of the spinning magnetic tops. Consequently, spinning tops contacting spinning member 730 may slow down or stop. As another example, spinning member 732 of FIG. 7.4 may be configured to control the motor such that the motor rotates in the same direction as the spinning tops, thereby increasing the speed of the spinning tops upon contact. Spinning members 712 may snap into place in a motor operated spinning base (not shown) in the bottom surface of the play surface 710, and may control the motor using magnets positioned at different locations (e.g., a first location for clockwise rotation and second location for counter-clockwise rotation) that cooperate with corresponding switches within the base.

FIGS. 10.1 and 10.2 depict an embodiment of an attachment strap 1000 that may be used with a top launcher mounted on a user's hand, as discussed above. In embodiments, the attachment 1000 strap may comprise a first toothed slider 1001, a second toothed slider 1002, a ratchet knob 1003, a ratchet clutch 1004, and a ratchet gear and casing 1005. The length of the attachment strap may be adjusted by turning the ratchet knob 1003 counterclockwise to enlarge the strap length, and clockwise to reduce the length. In embodiments, this mechanism may comprise a mechanism substantially similar to those used in a bicycle helmet adjustment strap.

In an embodiment, a magnetic top may be configured with a light source, such as a light emitting lower region. The light emitting lower region may be near the lower tip of the magnetic top or may be within a tip, such that the tip emits light. Thus, a user may follow the top movements by watching the movement of the tip in conditions of moderate, low, or no ambient lighting.

Figure 8:
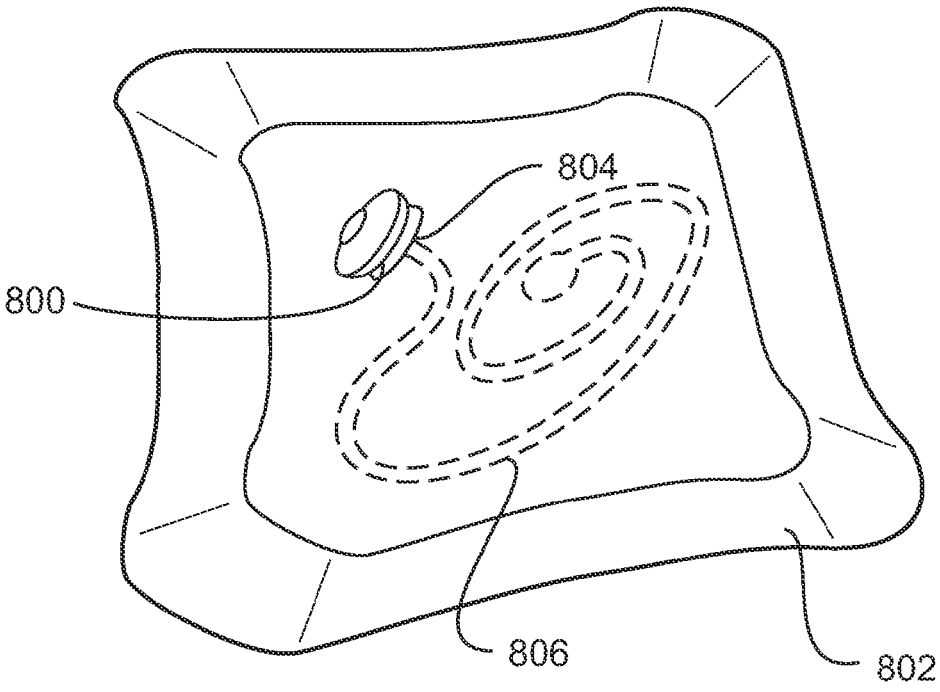
FIG. 8 is a schematic diagram of an embodiment of a light emitting magnetic top system.

In an embodiment depicted in FIG. 8, a light emitting magnetic top 800 may be configured to operate on a play surface 802 that contains a photoluminescent material that may be a fluorescent or phosphorescent material. When the light emitting magnetic top 800 travels over play surface 800, it may emit light from its tip region 804 that is of sufficient energy and intensity to stimulate the play surface 800 to glow in the regions (or path) traversed by light emitting magnetic top 800, as represented by the dashed lines 806 in FIG. 8. The exact location of a light in the tip region, the intensity and energy of the light, and the fluorescent or phosphorescent material, may be tailored to vary the width of the glowing path, as well as the duration of the glowing path. Thus, a record of the path of magnetic top 800 may be temporarily displayed by play surface 802. Accordingly, a user may launch and guide light emitting magnetic top over the play surface using a respective top launcher and controller, as described above, and view the current position of the top as well as a record of its previous path, thus adding to the user play experience. Thus, a movement pattern performed by the user when the user maintains a top controlling device in magnetic proximity to magnetic top 800 may be recorded as a pattern of light in the play surface.

As noted above, the energy of the light in light emitting magnetic top 800 may be tailored. For example, a UV light emitting diode (LED) may be used that produces energy mainly in the ultraviolet range with a small amount of energy in the blue range of the visible spectrum. Ultraviolet light has sufficient energy to cause fluorescence or phosphorescence in the visible light range, such that phosphors emitting over a range of visible wavelengths may be used in conjunction with a UV LED. Thus, a user may view a UV LED tip in top 800 that emits a color that appears blue or white to the user, and creates a yellow, green, or red glowing path on play surface 802 in its wake.

In embodiments, the play pattern of magnetic tops may be varied according to the type of top. After tops are launched into a battle area (e.g., any flat surface or a confined arena), the tops may be controlled by individual users using a controlling device as described above. Players may try to hit their tops together in a battle area, hoping to stop the spinning of their opponent's top. The length/type of play pattern may be impacted by the type of parts chosen by the player to add to that player's top. Different tops may have more offensive characteristics, while others may be more defensive and stable. Thus, the outcome of a battle between tops may be determined by the players' skills at controlling their tops and also by the geometry and construction of the tops themselves.

In another embodiment, FIG. 11 depicts a magnetic top 1100 that may be configured to be launched by a rip cord device 1102 of known structure, rather than by a magnetic launcher. Guidance of the spinning magnetic top 1100 may then proceed using a magnetic controlling device as described above.

In another embodiment, a magnetic top may include provisions for activating moving parts of the top while the top is spinning. The moving parts may affect the way that the top spins or the way that the top interacts with other spinning tops. For example, the moving parts may be a changeable tip, an extendable and retractable striking member, an extendable and retractable shield member, and a rotating shield. The moving parts may be activated by pressing a centrally located button on the top surface of the magnetic top, which may electronically or mechanically actuate the moving parts. In a further embodiment, a top controller may include an actuator configured to press the button while the top is spinning. In addition to moving parts, the actuator and button may also activate electronic features, such as sounds or lights. In another embodiment, an actuator may remotely activate a feature of a top without physically contacting the top, for example, using a magnet, a light source, a radio signal source, or any other device capable of triggering a complementary receiving device in the top.

FIG. 12.1 illustrates an embodiment of a magnetic top 1200 and top controller 1202 for activating moving parts of the top 1200 while the top 1200 is spinning. Top 1200 may have a construction similar to that described above in reference to magnetic top 290 of FIGS. 2.9 and 2.10. Top controller 1202 may have an actuator 1204 configured to press an activation button on the magnetic top 1202, as represented by the arrow 1206. The pressing of the button in turn activates moving parts within top 1200, as represented by arrow 1208. In the case of an extendable and retractable moving part, the magnetic top 1200 may be configured to extend the moving part in response to a first press of the button, and then retract the moving part in response to a second press of the button. Moving parts may be moved, for example, by mechanical means such as spring loaded mechanisms, or by electronic means such as battery powered motors.

As one embodiment, FIGS. 12.2-12.4 illustrate the activation of a spinning magnetic top 1210 having extendable and retractable striking members 1211. FIG. 12.2 illustrates magnetic top 1210 with striking members 1211 in a retracted state before activation. As shown in FIG. 12.3, the actuator 1212 of a top controller 1213 may be pressed against the activation switch 1214 of the magnetic top 1210, which may cause the top 1210 to extend the striking members 1211 outward in a radial direction, perpendicular to the rotational axis of the top 1210, as represented by the arrow 1215. As shown in FIG. 12.4, the actuator 1212 may be removed from the magnetic top 1210, thereby leaving the striking members 1211 in an extended position. To retract the striking members 1211, a user may press the activation switch 1214 a second time with the actuator 1212, which may cause the magnetic top 1210 to retract the striking members 1211 to their original retracted positions, as shown in FIG. 12.2. Upon release of the activation switch 1214 the second time, the magnetic top 1211 may remain in the retracted position until the activation switch 1214 is pressed again.

As another embodiment, FIGS. 12.5 and 12.6 illustrate a spinning magnetic top 1220 having extendable and retractable shield members 1221. FIG. 12.5 illustrates shield members 1221 in a retracted state before activation. As shown in FIG. 12.6, the actuator 1212 of a top controller 1213 may be pressed against the activation switch of the magnetic top 1220, which may cause the top 1220 to raise the shield members 1221 up away from the playing surface, and outward in a radial direction, perpendicular to the spinning axis of the top 1220, as represented by the arrows 1225. From the extended state shown in FIG. 12.6, a user may press the activation switch a second time with the actuator 1212, which may cause the magnetic top 1220 to retract the shield members 1221 to their original retracted positions, as shown in FIG. 12.5. Upon release of the activation switch the second time, the magnetic top 1211 may remain in the retracted position until the activation switch is pressed again.

As another embodiment, FIGS. 12.7 and 12.8 illustrate a magnetic top 1230 having a changeable tip 1231, which may be changed while the top 1230 is spinning. FIG. 12.7 illustrates tip 1231 in a first configuration, with a projecting member 1232 extended through and beyond an opening 1233 in a bottom housing 1235 of the magnetic top 1230. In this first configuration, top 1230 may spin on the projecting member 1232. As shown in FIG. 12.8, while top 1230 is spinning, the actuator 1212 of a top controller 1213 may be pressed against the activation switch of the magnetic top 1230, which may cause the top 1230 to retract the projecting member 1232 inside the bottom housing 1235. With the projecting member 1232 retracted, the magnetic top 1230 may spin on a projecting portion 1234 of the housing 1235, which may be wider than the projecting member 1232 and thereby provide different spinning characteristics. For example, a wider projecting portion 1234 may enhance the stability of the spinning top 1230, and reduce the tendency of the top 1230 to wobble or tilt its spinning axis relative to a play surface. After removing the actuator 1212, the top 1230 may keep the projecting member 1232 retracted as shown in FIG. 12.8. From the retracted position, the activation switch may be pressed a second time with actuator 1212 to eject projecting member 1232 from opening 1233 to its original extended position, as shown in FIG. 12.7. Upon release of the activation switch the second time, the magnetic top 1230 may remain in the extended position until the activation switch is pressed again.

As another embodiment, FIGS. 12.9 and 12.10 illustrate a magnetic top 1240 having a rotating shield member 1241, which may be activated while the top 1240 is spinning. The rotating shield member 1241 may be coupled to a spring loaded mechanism that enables the member 1241 to be rotated in a first direction to wind and load a spring. The mechanism may include a releasable latch that keeps the spring loaded while the member 1241 is rotated in the first direction, and prevents the member 1241 from spinning in the opposite second direction. The releasable latch may be coupled to an activation switch in the upper surface of the magnetic top 1240.

As shown in FIG. 12.9, a user 1250 may rotate the member 1241 in a first direction to load the spring, as represented by the arrow 1242 (in this example, counterclockwise). As shown in FIG. 12.10, with the spring loaded and with the top 1240 spinning, an actuator 1212 of a top controller 1213 may be pressed against the activation switch, which releases the releasable latch and the spring, allowing the shield member 1241 to rotate in the opposite second direction as represented by the arrow 1243 (in this example, clockwise). The shield member 1241 may rotate in the same or opposite direction as the direction of rotation of the spinning top 1240. In a further embodiment, the activation switch may be pressed a second time to stop the member 1241 from rotating.

In an alternative embodiment, magnetic top 1240 may have a mechanism that mechanically rotates the shield member 1241 when the activation switch is depressed. For example, the activation switch may be coupled to a clutch and freewheel gear mechanism, such that when the switch is depressed, the clutch further energizes the gear mechanism and increases the speed of rotation of the shield member 1241.

In another alternative embodiment, magnetic top 1240 may have a shield member 1241 rotated by a battery powered motor that is controlled by the activation switch. In this manner, the shield member 1241 may be turned on (rotating) and off (not rotating) by pressing the activation switch. In addition, the activation switch and motor may be configured to control and change the direction of rotation of the shield member 1241.

Further embodiments of the present invention may provide magnetic launchers configured to pick, spin, and launch toys from positions other than a generally downward pointing, vertical orientation typically used to launch tops on a horizontal play surface. For example, in one embodiment, a magnetic launcher may be oriented with the spinning axis of its rotating member parallel to a horizontal play surface, such that a top or other toy is spun and launched so that it spins and travels along the play surface. In one implementation, the spinning toy may be formed as a wheel that is magnetically coupled to the magnetic launcher, spun by the rotating member, and then released with a flick of the wrist or tap on the launcher, causing the wheel to roll across a horizontal play surface. In a further implementation, the wheel may be a component of a vehicle, such that spinning and launching the wheel causes the entire vehicle to travel across the horizontal play surface.

In another embodiment, a magnetic launcher may be oriented with its rotating member pointing generally upward away from a horizontal play surface, and with the spinning axis of its rotating member perpendicular to the horizontal play surface, such that a toy is spun and launched upward into the air away from the play surface. The toy may be, for example, any toy that produces lift when spun, e.g., flying toys such as propellers, planes, and helicopters.

Although embodiments discussed above use battery operated launchers, one of skill in the art would appreciate that a launcher may be powered by other means. For example, in one embodiment, a launcher may be manually powered, e.g., having a spring loaded gear box actuated by a trigger that the user repeatedly squeezes until a desired rotation speed is obtained. Spring loaded gear boxes such as those used in friction cars or sparking toy guns may be used.

The foregoing disclosure of the preferred embodiments has been presented for purposes of illustration and description. It is not intended to be exhaustive or to limit the invention to the precise forms disclosed. Many variations and modifications of the embodiments described herein will be apparent to one of ordinary skill in the art in light of the above disclosure. For example, although the magnetic top launching devices have been depicted herein as having disk-shaped spinning portions, the present invention covers embodiments where the spinning portions of the magnetic launcher are barrel-shaped or have other shapes. Additionally, any number and configuration of magnetic portions may be included in the magnetic top launcher and magnetic top to achieve the desired magnetic coupling. Moreover, although the top controlling devices have been depicted herein as worn on a user's finger(s), the present invention covers embodiments where a top-controlling device is grasped by the user or worn otherwise. Thus, a top controlling device may have a shape of a pen, a dumbbell, a disk, or any convenient shape that may include a magnet to be brought into proximity of the magnetic spinning top.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

Further, in describing representative embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the present invention.

What is claimed is:

1. A magnetic top assembled from a plurality of parts, the top comprising:

a magnetic core part;

a tip part; and a tip holder, wherein the tip part is held between the magnetic core part and the tip holder, wherein the tip part extends through an opening in the tip holder, and wherein the tip holder engages the magnetic core part to hold the parts together in an assembly, wherein the assembled top has a tip portion and a head portion opposite to the tip portion, wherein the assembled top spins around a rotational axis extending from the head portion to the tip portion, wherein the core magnetic part provides at least one magnet disposed in the head portion of the assembled top, wherein the magnetic to further comprises an extendable and retractable tip that is activated by a switch disposed on the head portion and centered at the rotational axis, and wherein the extendable and retractable tip extends out of, and retracts within, an opening in the tip part that is aligned with the rotational axis.

2. The magnetic top of claim 1, wherein the at least one magnet comprises a first magnet centered at the rotational axis of the top and a plurality of outer magnets located a radial distance from the first magnet and equally spaced around the first magnet.

3. The magnetic top of claim 1, wherein the top further comprises an intermediate part held between the magnetic core part and the tip holder.

4. The magnetic top of claim 3, wherein the intermediate part comprises one of a spin performance ring and a bumper.

5. The magnetic top of claim 1, wherein the top further comprises a bumper part attached to the magnetic core part on a side of the magnetic core part opposite to the tip holder, and wherein the bumper part extends radially farthest from the rotational axis.

6. The magnetic top of claim 2, wherein the plurality of outer magnets comprises three magnets.

7. The magnetic top of claim 1, wherein the at least one magnet comprises a magnet disposed in the head portion of the assembled top and centered at the rotational axis of the top, wherein the magnet is disposed within a socket, and wherein the socket is configured to receive a projecting flange of a top launcher spinning member and to magnetically couple with a metal insert held within the projecting flange.

8. A magnetic top assembled from a plurality of parts, the to comprising:

a magnetic core part;

a tip part; and a tip holder, wherein the tip part is held between the magnetic core part and the tip holder, wherein the tip part extends through an opening in the tip holder, and wherein the tip holder engages the magnetic core part to hold the parts together in an assembly, wherein the assembled top has a tip portion and a head portion opposite to the tip portion, wherein the assembled top spins around a rotational axis extending from the head portion to the tip portion, wherein the core magnetic part provides at least one magnet disposed in the head portion of the assembled top, wherein the magnetic top further comprises an extendable and retractable striking member that is activated by a switch disposed on the head portion and centered at the rotational axis, and wherein the striking member extends in the radial direction perpendicular to the rotational axis.

9. A magnetic top assembled from a plurality of parts, the to comprising:

a magnetic core part;

a tip part; and a tip holder, wherein the tip part is held between the magnetic core part and the tip holder, wherein the tip part extends through an opening in the tip holder, and wherein the tip holder engages the magnetic core part to hold the parts together in an assembly, wherein the assembled top has a tip portion and a head portion opposite to the tip portion, wherein the assembled top spins around a rotational axis extending from the head portion to the tip portion, wherein the core magnetic part provides at least one magnet disposed in the head portion of the assembled top, wherein the magnetic to further comprises an extendable and retractable shield member that is activated by a switch disposed on the head portion and centered at the rotational axis, and wherein the shield member moves away from the tip portion and away from the rotational axis.

10. A magnetic top assembled from a plurality of parts, the to comprising:

a magnetic core part;

a tip part; and a tip holder, wherein the tip part is held between the magnetic core part and the tip holder, wherein the tip part extends through an opening in the tip holder, and wherein the tip holder engages the magnetic core part to hold the parts together in an assembly, wherein the assembled top has a tip portion and a head portion opposite to the tip portion, wherein the assembled top spins around a rotational axis extending from the head portion to the tip portion, wherein the core magnetic part provides at least one magnet disposed in the head portion of the assembled top, and wherein the magnetic to further comprises a rotating shield member that rotates around the assembled top and is activated by a switch disposed on the head portion and centered at the rotational axis.

11. The magnetic top of claim 1, wherein actuation of the switch activates at least one of sounds and lights.

12. The magnetic top of claim 1, wherein the at least one magnet is disposed at an upper surface of the head portion opposite to the tip portion.

13. The magnetic top of claim 12, wherein the at least one magnet is exposed at the upper surface of the head portion.

14. A magnetic top assembled from a plurality of parts, the top comprising:

a locking magnetic part;

a core tip part; and a bumper part, wherein the locking magnetic part engages the core tip part to hold the bumper part between the locking magnetic part and the core tip part, wherein the locking magnetic part has a first face facing the bumper part and a second face opposite to the first face, wherein the locking magnetic part has at least one magnet disposed at the second face, wherein the locking magnetic part has a switch disposed at the second face, wherein the magnetic top spins around a rotational axis, wherein the switch is centered at the rotational axis of the magnetic top, wherein the switch activates a feature of the core tip part, wherein the core tip part comprises an extendable and retractable tip that is activated by the switch, and wherein the extendable and retractable tip extends out of, and retracts within, an opening in the core tip part that is aligned with the rotational axis.

15. The magnetic top of claim 14, wherein the switch of the locking magnetic part mechanically couples to a switch of the core tip part.

16. The magnetic top of claim 14, wherein the switch comprises the at least one magnet.

17. A magnetic top assembled from a plurality of parts, the top comprising:

a locking magnetic part;

a core tip part; and a bumper part, wherein the locking magnetic part engages the core tip part to hold the bumper part between the locking magnetic part and the core tip part, wherein the locking magnetic part has a first face facing the bumper part and a second face opposite to the first face, wherein the locking magnetic part has at least one magnet disposed at the second face, wherein the locking magnetic part has a switch disposed at the second face, wherein the magnetic to spins around a rotational axis, wherein the switch is centered at the rotational axis of the magnetic top, wherein the switch activates a feature of the core tip part, wherein the core tip part comprises an extendable and retractable striking member that is activated by the switch, and wherein the striking member extends in a radial direction perpendicular to the rotational axis.

18. A magnetic top assembled from a plurality of parts, the to comprising:

a locking magnetic part;

a core tip part; and a bumper part, wherein the locking magnetic part engages the core tip part to hold the bumper part between the locking magnetic part and the core tip part, wherein the locking magnetic part has a first face facing the bumper part and a second face opposite to the first face, wherein the locking magnetic part has at least one magnet disposed at the second face, wherein the locking magnetic part has a switch disposed at the second face, wherein the magnetic top spins around a rotational axis, wherein the switch is centered at the rotational axis of the magnetic top, wherein the switch activates a feature of the core tip part, wherein the core tip part comprises an extendable and retractable shield member that is activated by the switch, and wherein the shield member moves toward the locking magnetic part and away from the rotational axis.

19. A magnetic top assembled from a plurality of parts, the to comprising:

a locking magnetic part;

a core tip part; and a bumper part, wherein the locking magnetic part engages the core tip part to hold the bumper part between the locking magnetic part and the core tip part, wherein the locking magnetic part has a first face facing the bumper part and a second face opposite to the first face, wherein the locking magnetic part has at least one magnet disposed at the second face, wherein the locking magnetic part has a switch disposed at the second face, wherein the magnetic to spins around a rotational axis, wherein the switch is centered at the rotational axis of the magnetic top, wherein the switch activates a feature of the core tip part, and wherein the core tip part comprises a rotating shield member that rotates around the top and is activated by the switch.

20. The magnetic top of claim 14, wherein the bumper part extends radially farthest from the rotational axis.

* * * * *